US005923769A

United States Patent [19]

Fushimi

[11] Patent Number: 5,923,769

[45] **Date of Patent: *Jul. 13, 1999**

[54] ELECTROACOUSTIC TRANSDUCER

[75] Inventor: Isao Fushimi, Shizuoka, Japan

[73] Assignee: Star Micronics Co., Ltd., Shizuoka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/790,929

[22] Filed: Jan. 29, 1997

[30] Foreign Application Priority Data

Feb. 7, 1996 [JP] Japan ..... 8-021571

[51] Int. Cl.[6] ..... H04R 1/02; H04R 9/06; H04R 9/08

[52] U.S. Cl. ..... 381/338; 381/353; 381/396; 381/412; 381/413

[58] Field of Search ..... 381/202, 192, 381/193, 205, 396, 397, 413, 431, 423, 338, 345, 353, 382, 398, 332, 386, 412; 181/196, 166, 165, 148

[56] References Cited

U.S. PATENT DOCUMENTS 5,394,479 2/1995 Ishigaya et al. ..... 381/188
5,416,751 5/1995 Imahori et al. ..... 381/192
5,432,758 7/1995 Sone ..... 381/202
5,467,323 11/1995 Sone ..... 381/193
5,675,885 10/1997 Imahori et al. ..... 381/423
5,721,785 2/1998 Imahori ..... 381/396

*Primary Examiner*—Curtis A. Kuntz
*Assistant Examiner*—Rexford N. Barnie
*Attorney, Agent, or Firm*—Pollock, Vande Sande & Amernick

[57] ABSTRACT

The invention provides an electroacoustic transducer wherein the resonant chamber is given a space and volume necessary for resonance and the vibration system is given an efficient air damping effect and thereby undesired vibrations are suppressed with the resonant effect maintained. The electroacoustic transducer according to the invention is provided with a resonant chamber for resonating with the vibration of a diaphragm and a sound ejecting hole for communicating the resonant chamber with the outside air formed on a position off to the central axis of the diaphragm. Furthermore, an air damping means for compensating the lowering of the air damping effect due to the dislocation of the sound ejecting hole from the central axis of the diaphragm is provided on the inner wall of the resonant chamber so as to surround the central axis of the diaphragm.

9 Claims, 36 Drawing Sheets

ELECTROACOUSTIC TRANSDUCER

BACKGROUND OF THE INVENTION

1. Field of the Invention

The present invention relates to an electroacoustic transducer for transforming electronic signals into acoustic vibrations.

2. Description of the Prior Art

The conventional electroacoustic transducer has been constructed as illustrated in FIG. 20 and 21. A resonant chamber 102 is formed in front of a diaphragm 100, and a sound ejector 106 is incorporated with an outer case 104 whereby the resonant chamber 102 is enclosed. The sound ejector 106 is provided with a sound ejecting hole 108 communicating the resonant chamber 102 with the outside air. The diaphragm 100 is made of a magnetic substance and supported by a cylindrical magnet 110 served as a supporting means fixed on the back thereof. Furthermore, a magnetic driver 120 is placed on the central part of the backside of the diaphragm 100. The magnetic driver 120 transforms electronic signals into magnetic vibrations to produce mechanical vibrations in the diaphragm 100, and is mounted on a base 123 that forms a closed magnetic circuit with an iron core 122 and the magnet 110. A coil 124 is wound around the iron core 122. Furthermore, the terminals of the coil 124 are individually connected to a lead terminal 126 and 128 which are isolated from and mounted upright on the base 123. Input electronic signals are applied between the lead terminal 126 and 128.

FIG. 22 shows a sound pressure vs. frequency response characteristics (overall) of the electroacoustic transducer shown in FIG. 20, FIG. 23 shows a current vs. frequency response characteristics (overall) thereof, FIG. 24 shows a sound pressure vs. frequency response characteristics near the frequency where the response of the sound pressure becomes maximum, and FIG. 25 shows a current vs. frequency response characteristics near the frequency where the response of the sound pressure becomes maximum. In FIG. 24, there is not any irregularity on the waveform representing a chattering at D near 800 Hz. Furthermore, FIG. 26 shows a sound pressure vs. frequency response characteristics (overall) of the electroacoustic transducer shown in FIG. 21, and FIG. 27 shows a current vs. frequency response characteristics (overall) thereof. In FIG. 26, the sound pressure characteristics around E show a comparably flat response.

In the case of the electroacoustic transducer shown in FIG. 20, the sound ejecting hole 108 is placed on the central axis O, however, the position can be shifted depending on the functional requirements for ejecting sounds. In recent years, in electronics such as a portable telephone which employs such an electroacoustic transducer, the sound ejecting hole 108 is often subject to change of the position from which sounds are ejected in compliance with various requirements for miniaturization, flatness, and the like.

Accordingly, an electroacoustic transducer in which the sound ejecting hole 108 is formed at an irregular position has been proposed in order to comply with such requirements, The electroacoustic transducer shown in FIG. 28, 29 has the sound ejecting hole 108 formed on the ceiling close to the side wall of the outer case 104. The electroacoustic transducer shown in FIG. 30 has the sound ejecting hole 108 formed on the side wall of the outer case 104. The foregoing positions where the sound ejecting holes 108 are formed are shown as an example, and the sound ejecting hole 108 can also be formed on the corner of the outer case 104.

Incidentally, in the electroacoustic transducer in which the sound ejecting hole 108 is formed at a position off to the central axis O of the diaphragm 100, the resonance frequency of the resonant chamber 102 can be tuned by changing the diameter and length of the sound ejecting hole 108, even if the sound ejecting hole 108 is placed off to the central axis O of the diaphragm 100. However, the relation between the vibration of the diaphragm 100 and the sound ejecting hole 108 becomes weak. In consequence, the air damping effect by the sound ejecting hole 108 weakens, and such an electroacoustic transducer is apt to assume acoustic characteristics different from that of the electroacoustic transducer with the sound ejecting hole 108 around the central axis O of the diaphragm 100. The electroacoustic transducer is likely to be required for a higher power, wider frequency range, and higher sound quality as well as miniaturization. In order to comply with such requirements, the acoustic load by the resonant chamber 102 has generally been utilized as an air damping factor when the vibration system vibrates in a higher amplitude.

In the electroacoustic transducer shown in FIG. 29 and 30, increasing the vibration amplitude will make a sharp sound pressure vs. frequency response characteristics, or cause chatterings around the peripheral support of the diaphragm 100. FIG. 31 shows a sound pressure vs. frequency response characteristics (overall) of the electroacoustic transducer shown in FIG. 29, FIG. 32 shows a current vs. frequency response characteristics (overall) thereof. In FIG. 31, the characteristics around F shows a sharp response of the sound pressure. Furthermore, FIG. 33 shows a sound pressure vs. frequency response characteristics (overall) of the electroacoustic transducer shown in FIG. 30, FIG. 34 shows a current vs. frequency response characteristics thereof, FIG. 35 shows a sound pressure vs. frequency response characteristics near the frequency where the sound pressure becomes maximum, and FIG. 36 shows a current vs. frequency characteristics near the frequency where the sound pressure becomes maximum. FIG. 35 shows that chatterings are produced around the periphery of the diaphragm 100 at G near 800 Hz, namely, at the maximum amplitude. In order to avoid such a phenomenon, the requirements for the diaphragm 100 cannot be ignored. It is undeniable that thinning the thickness of the diaphragm 100 in comparison with the diameter thereof is apt to increase higher harmonics owing to chatterings and divided vibrations.

Such a phenomenon and the countermeasure thereof have been disclosed, for example, in JP-U-56-52719, in which a countermeasure to increase the acoustic impedance inside a resonant chamber is clarified. Although such a countermeasure can be considered to be effective in damping the foregoing phenomenon, it is possible to decrease the volume of a resonant chamber and thereby to weaken the resonant effect thereof.

SUMMARY OF THE INVENTION

Accordingly, it is an object of the present invention to provide an electroacoustic transducer wherein the resonant chamber is given a space and volume necessary for resonance and the vibration system is given an efficient air damping effect and thereby undesired vibrations are suppressed with the resonant effect maintained.

An electroacoustic transducer according to one aspect of the present invention is provided with, as shown in FIG. 1 through 9, a resonant chamber (50) for resonating with a vibration of a diaphragm (38) and a sound ejecting hole (54) for communicating the resonant chamber with the outside air, formed at a position off to the central axis of the diaphragm; and it is characterized in that an air damping means (rib 56) for compensating the lowering of air damping due to the dislocation of the sound ejecting hole from the central axis of the diaphragm is provided on the inner wall of the resonant chamber so as to surround the central axis of the diaphragm. Namely, the provision of the air damping means inside the resonant chamber compensates the lowering of the air damping effect due to the dislocation of the sound ejecting hole from the central axis of the diaphragm. In other words, the vibration amplitude of the diaphragm is damped by the air damping means.

An electroacoustic transducer according to another aspect of the invention is characterized in that the aforementioned air damping means is formed of a cylindrical body surrounding the central axis of the diaphragm. Namely, the air damping effect can be acquired with a form similar to the conventional sound ejecting cylindrical body by making the air damping means in a cylindrical body.

Furthermore, an electroacoustic transducer according to another aspect of the invention is characterized in that the air damping means is formed of a rib surrounding an air space around the central axis of the diaphragm and the sound ejecting hole is made inside the air space. In other words, the rib as the air damping means is extended to the sound ejecting hole shifted from the central axis of the diaphragm, thereby introducing the sound pressure inside the rib toward the off-centered sound ejecting hole to eject it outside with the air damping effect maintained.

BRIEF DESCRIPTION OF THE DRAWINGS

The present invention will be fully understood from the detailed description given below and from the accompanying drawings of the preferred embodiments of the invention, which, however, should not be taken to limit the specific embodiment, but are for explanation and understanding, in which.

DETAILED DESCRIPTION OF THE PREFERRED EMBODIMENTS

Preferred embodiments of the present invention will hereafter be described in detail with reference to the accompanying drawings.

Figure 1:
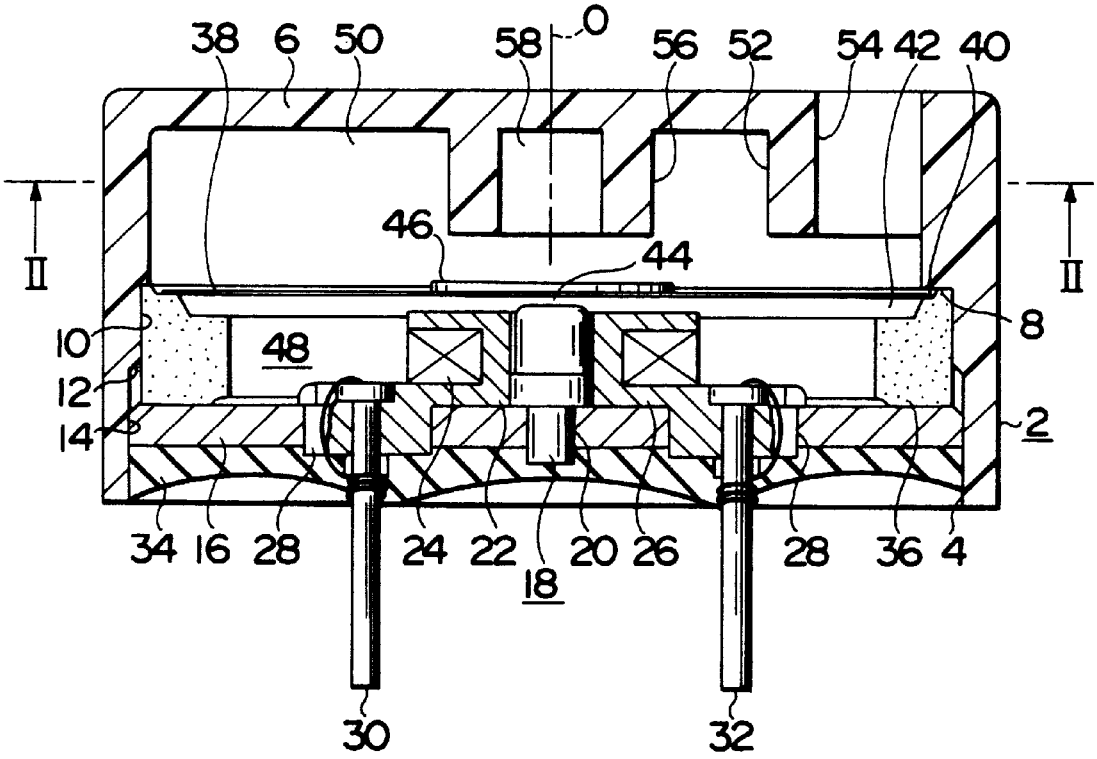
FIG. 1 is a longitudinal sectional view showing the first embodiment of an electroacoustic transducer according to the present invention.
Figure 2:
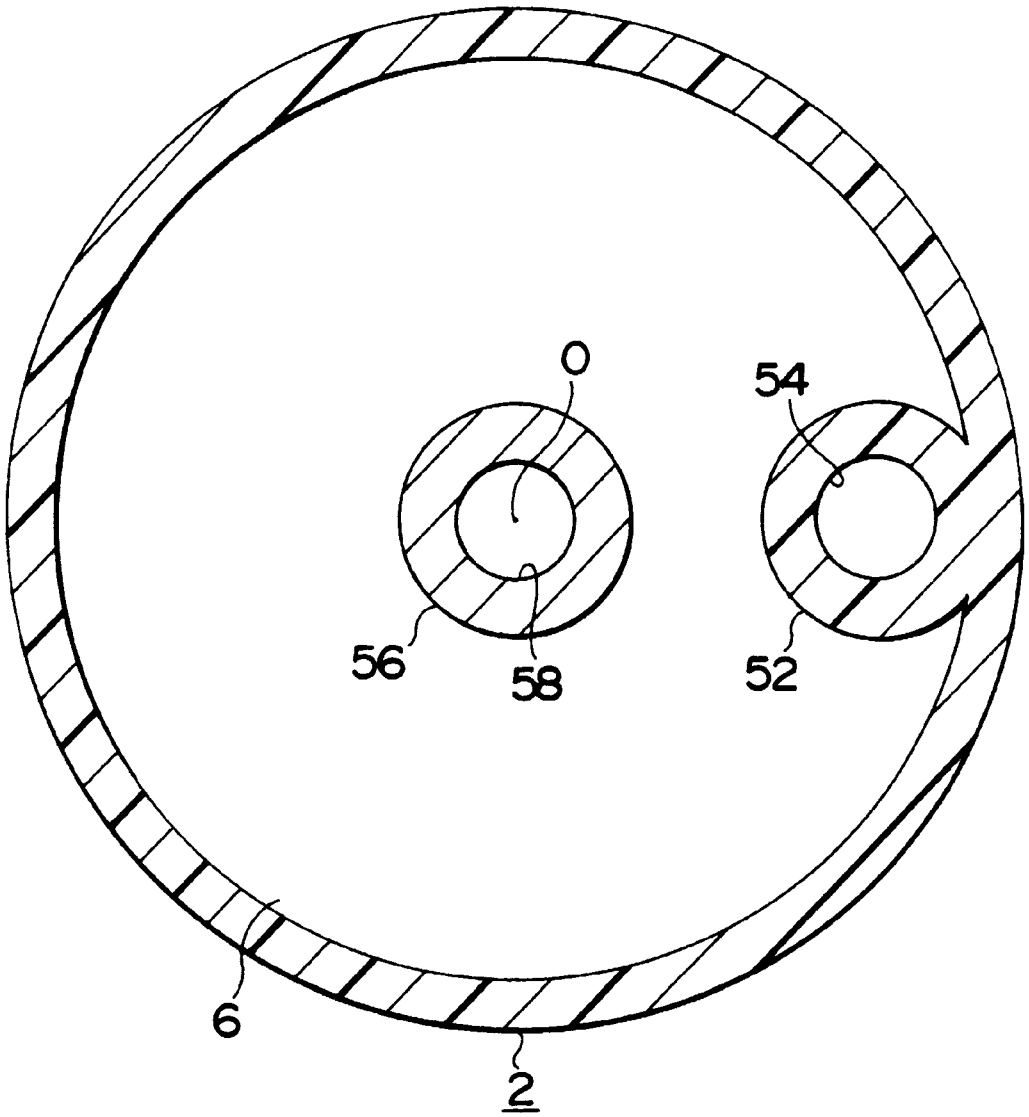
FIG. 2 is a sectional view taken on by the line II—II in the drawing of the electroacoustic transducer shown in FIG. 1.

FIG. 1 and 2 show the first embodiment of the electroacoustic transducer according to the present invention. An outer case 2 is made of a synthetic resin or the like to be formed into, for example, a cylindrical body, and an opening 4 is provided on one end and a ceiling 6 on the other. A first large internal diameter part 10 provided with a stepped part 8 and a second large internal diameter part 14 provided with a sloped stepped part 12 are formed inside of the outer case 2.

A diskform base 16 formed of a magnetic material of iron or the like is fixed onto the second large internal diameter part 14. A small diameter part 20 of an iron core 18 is fixed on the center of the base 16 by means of press-fit or caulking. That is, the iron core 18 and the base 16 are connected mechanically and magnetically. A coil bobbin 22 formed of an insulating material such as a synthetic resin or the like is mounted on the iron core 18. A coil 24 is wound around the coil bobbin 22. Positive and negative lead terminals 30, 32 of a bar-form are fixed on a pair of terminal supporting parts 28 projectingly formed with the lower flange of the coil bobbin 22. The terminals 30, 32 are formed to be incorporated with the bobbin 22 by means of the insert molding or the like. The terminal supporting parts 28 are put in through clearance holes formed on the base 16, on the back of which the lead terminals 30, 32 are projected out. The terminals of the coil 24 are secured on the base ends of the lead terminals 30, 32 by means of soldering or the like and at the same time electronically connected thereon. The base 16 is fitted inside the opening 4 of the outer case 2 and at the same time fixed by an insulating adhesive 34.

Furthermore, an annular magnet 36 is placed to surround the coil bobbin 22 between the upper side of the base 16 and the stepped part 8 of the outer case 2. The magnet 36 also functioning as a support means to mount a diaphragm 38 has a stepped support part 40 formed to support the diaphragm, and at the same time it has a recessed part 42 formed on the back of the diaphragm 38 in order to secure a space for the vibration. The peripheral edge of the diaphragm 38 made of a magnetic plate is mounted on the stepped support part 40, and the diaphragm 38 is horizontally supported with a gap 44 provided between the top of the iron core 18 and the diaphragm 38. A magnetic piece 46 to increase the vibrational mass of the diaphragm 38 is attached on the center of the diaphragm 38. Therefore, the magnet 36, base 16, iron core 18, and diaphragm 38 constitute a closed magnetic circuit, and the diaphragm 38 is retained to be attracted by the magnetic force of the magnet 36. Furthermore, by feeding an alternating current to the lead terminal 30 through 32, the base 16, coil 24, iron core 18, and magnet 36 constitute a magnetic driver 48 to generate magnetic vibrations in the diaphragm 38.

A resonant chamber 50 is formed on the upper side of the diaphragm 38 so as to be enclosed by the outer case 2. The resonant chamber 50 is a space to resonate with the vibration of the diaphragm 38, and the vibrational medium is the air inside the resonant chamber 50. The diaphragm 38 has a natural frequency, on the other hand, the resonant chamber 50 has a characteristic frequency determined by the volume and shape thereof.

In the resonant chamber 50 of this embodiment, a sound ejecting part 52 is formed at a position off to the central axis O of the diaphragm 38, and a sound ejecting hole 54 to communicate the resonant chamber 50 with the outside air is formed on the sound ejecting part 52. Thus, the sound ejecting hole 54 is formed at a decentered position from the central axis of the diaphragm 38, on the other hand, a cylindrical rib 56 as an air damping means for compensating the lowering of the air damping effect against the vibration of the diaphragm 38 is formed in such a manner that the rib hangs down from the ceiling of the outer case 2 so as to surround the central axis of the diaphragm 38. This cylindrical rib 56 takes a form similar to the conventional sound ejecting cylinder, which, however, does not have the hole to communicate the inside air with the outside. Namely, a space 58 surrounded by the cylindrical rib 56 forms a closed space facing the central part of the diaphragm 38.

In the foregoing construction, the action will now be described. Feeding a continuous oscillating current such as a rectangular pulse train or sinewave alternating current to the lead terminal 30 through 32 generates an alternating magnetic field corresponding with the frequency in the coil 24. The magnetic field acts upon the diaphragm 38 having the magnetic piece 46 through the gap 44. Although a static magnetic field from the magnet 36 acts on the diaphragm 38 being a magnetic plate, when the alternating magnetic field is given, the diaphragm 38 receives an attraction and repulsion force generated by the interaction between the alternating magnetic field and the unidirectional magnetic field, and thereby the diaphragm 38 vibrates vertically. In this vibration mode, the maximum amplitude occurs at the center of the diaphragm 38 and the vibration amplitude decreases toward the peripheral thereof Since the diaphragm 38 is made of a thin magnetic plate, this vibration mode can be considered as the vibration of membrane. On the other hand, the air in the resonant chamber is a fluid and assumes viscosity in a strict sense. Considering the vibration of the diaphragm 38 and the resonant action of the resonant chamber 50, it is clear that the sound pressure becomes the highest at the center of the diaphragm 38 and decreases toward the peripheral thereof. Therefore, when the sound ejecting part 52 is shifted from the center of the diaphragm 38 to the peripheral side as in this embodiment, undeniably the air damping effect lowers as compared with the conventional that has the sound ejecting part formed around the central axis of the diaphragm 38.

Accordingly, the cylindrical rib 56 as the air damping means is formed around the central axis of the diaphragm 38, and the air in the space 58 surrounded by the cylindrical rib 56 functions as the air damper against the maximum vibration amplitude, namely, the maximum sound pressure of the diaphragm 38. In other words, when the diaphragm 38 moves up, the air inside the cylindrical rib 56 is compressed; and the reaction damps the vibration of the diaphragm 38. Such a damping effect rises as the vibration amplitude of the diaphragm 38 increases, when an excessive amplitude is given to generate abnormal vibrations such as chatterings on the periphery of the diaphragm 38; and it lowers when the amplitude decreases. Thus, the lowering of the air damping effect depending on the position of the sound ejecting part 52 will be compensated owing to the air damping effect by the cylindrical rib 56. Furthermore, such an air damping effect acts in the frequency region where the amplitude is excessively high, and therefore, the deviation of the frequency characteristics, namely, the sharpening of the sound pressure characteristics can be suppressed, and flatness of the sound pressure characteristics can be expected.

Although the cylindrical rib 56 does not serve as a sound ejector to the outside, it functions as an air damper equivalent to the acoustic impedance of the conventional sound ejecting part due to the viscosity of air. That is, the cylindrical rib 56 materializes only the air damping effect of the sound ejecting effect and air damping effect which are provided with the conventional sound ejecting part; and the sound ejecting effect to the outside is carried out by the sound ejecting part 52 and the sound ejecting hole 54 provided at a position deviated from the center. Therefore, the separate provision of such an air damping means will enhance the degree of freedom as to the position where the sound ejecting hole 54 for serving only as the sound ejector is to be formed.

Figure 3:
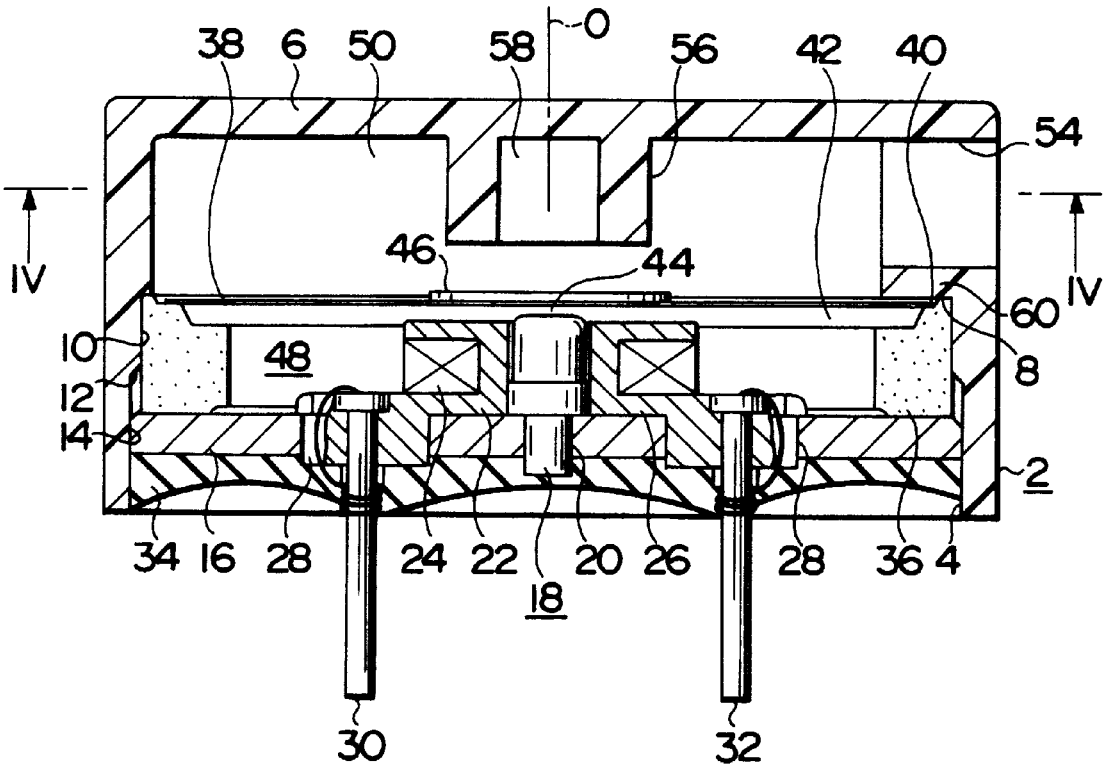
FIG. 3 is a longitudinal sectional view showing the second embodiment of an electroacoustic transducer according to the present invention.
Figure 4:
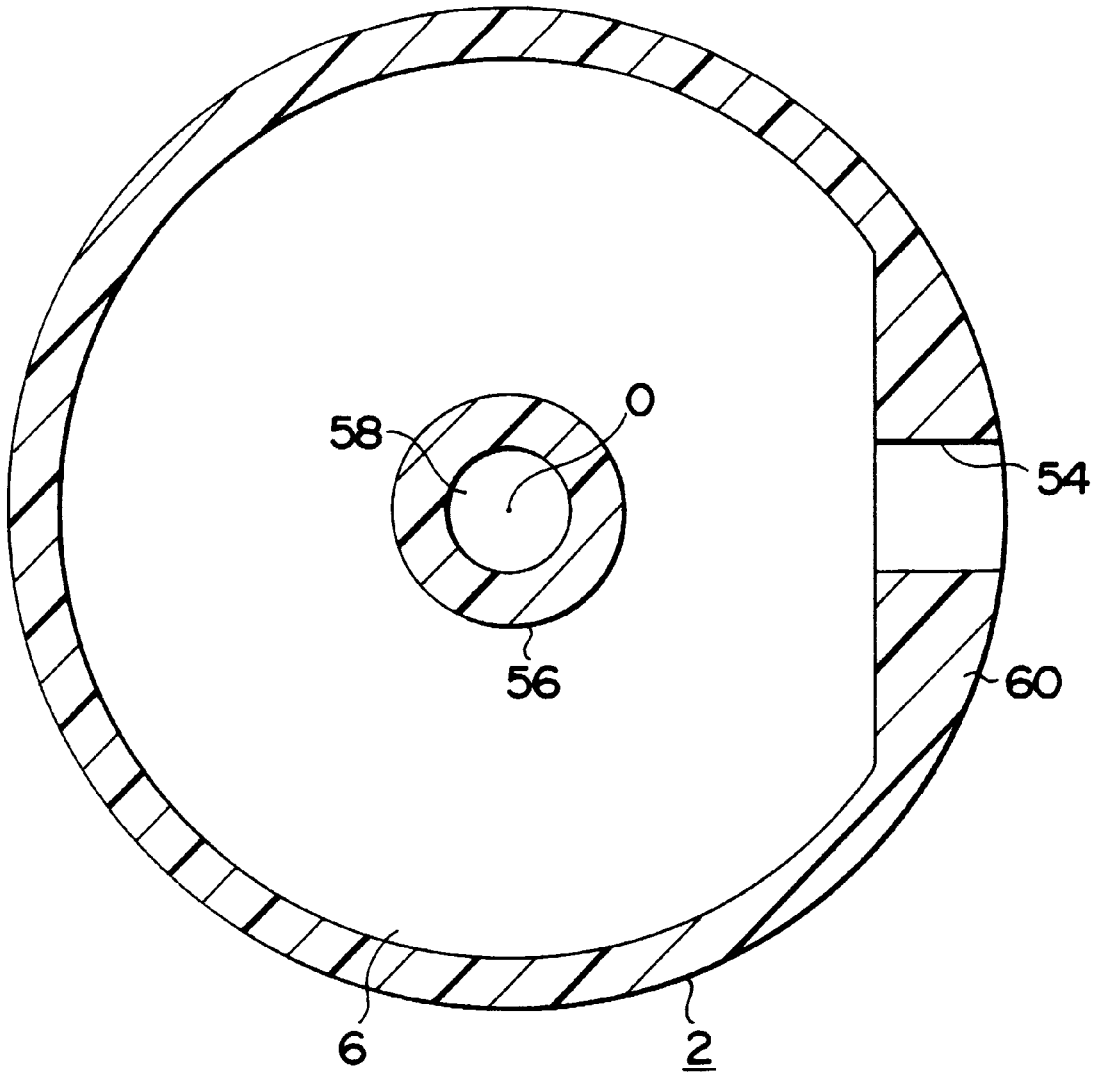
FIG. 4 is a sectional view taken on by the line IV—IV in the drawing of the electroacoustic transducer shown in FIG. 1.

Next, FIG. 3 and 4 illustrate the second embodiment of the electroacoustic transducer according to the present invention. In the electroacoustic transducer of this embodiment, a thickness part 60 is formed in the wall of the outer case 2 and the sound ejecting hole 54 is formed in the thickness part 60 in the direction perpendicular to the central axis O of the diaphragm 38; and the cylindrical rib 56 as the air damping means is formed on the ceiling of the outer case around the central axis of the diaphragm 38 in the same manner as in the first embodiment. With the foregoing formation of the sound ejecting hole 54, the second embodiment will achieve a similar effect to the electroacoustic transducer of the first embodiment.

Figure 5:
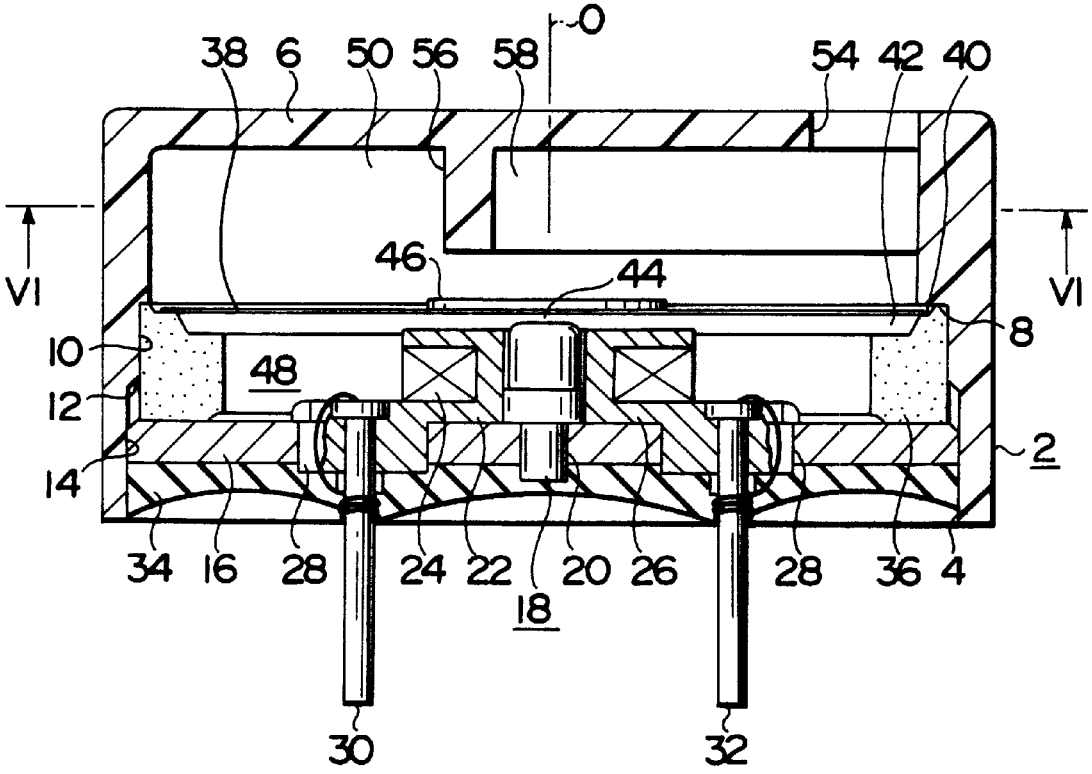
FIG. 5 is a longitudinal sectional view showing the third embodiment of an electroacoustic transducer according to the present invention.
Figure 6:
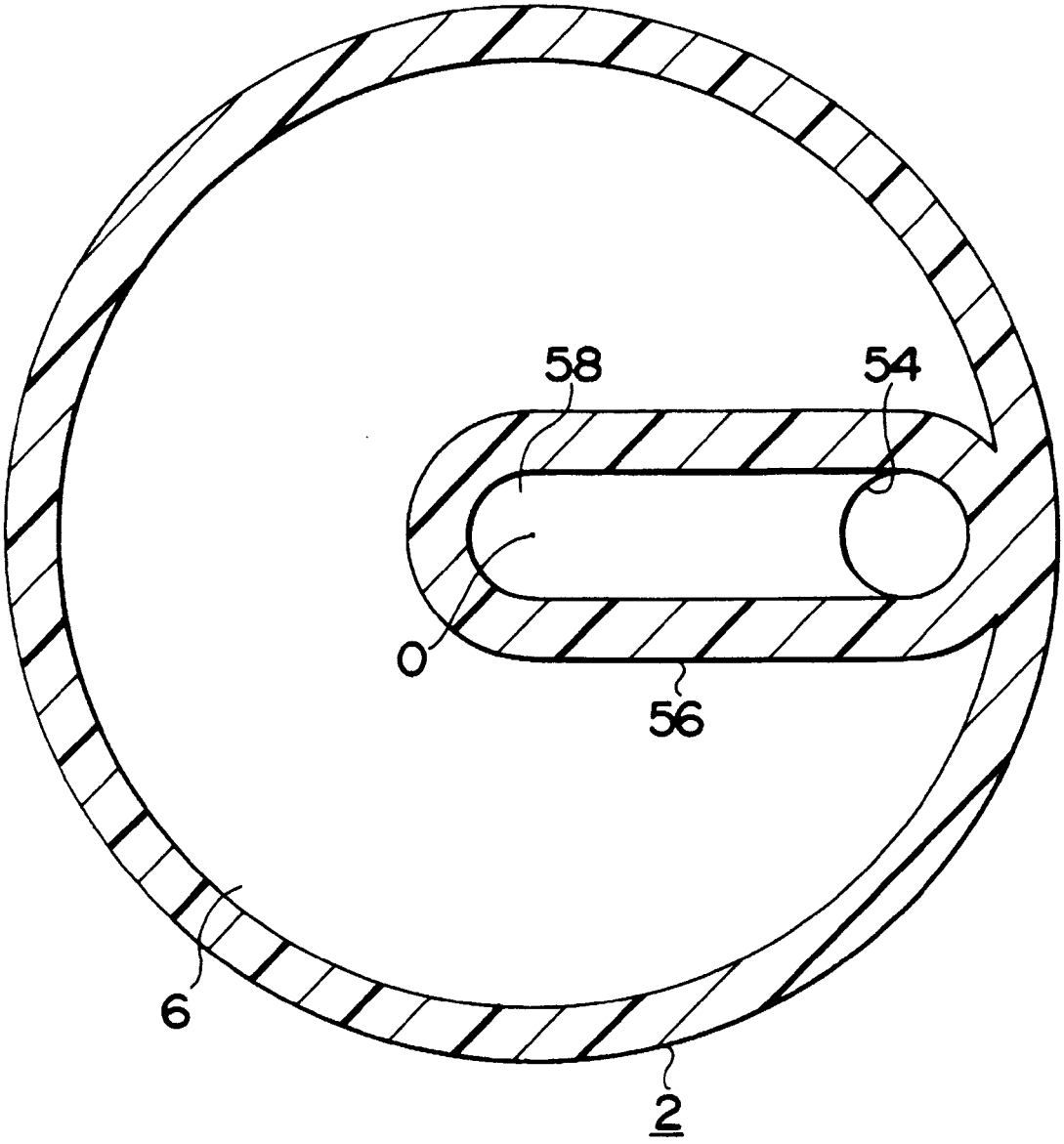
FIG. 6 is a sectional view taken on by the line VI—VI in the drawing of the electroacoustic transducer shown in FIG. 1.

Next, FIG. 5 and 6 illustrate the third embodiment of the electroacoustic transducer according to the present invention. In the electroacoustic transducer of this embodiment, the cylindrical rib 56 in the first embodiment is extended toward the sound ejecting part 52 so as to be incorporated therewith. To be more specific, an oval cylindrical rib 56 is formed to surround the central axis of the diaphragm 38, the sound ejecting hole 54 is placed at a position off to the central axis O of the diaphragm 38.

With the foregoing oval cylindrical rib 56 formed on the side of the sound ejecting hole 54 to be decentered from the central axis of the diaphragm, the rib will function as a waveguide to transmit the sound pressure on the central axis of the diaphragm to the sound ejecting hole. Therefore, the lowering of the air damping effect due to the displacement of the sound ejecting hole 54 can be compensated in the same manner as in the electroacoustic transducer of the first embodiment, the degree of freedom on the location of the sound ejecting hole 54 can be enhanced, and at the same time the easiness to form the outer case 2 can be improved since two cylindrical bodies are not needed to be projected as needed in the first embodiment.

Figure 7:
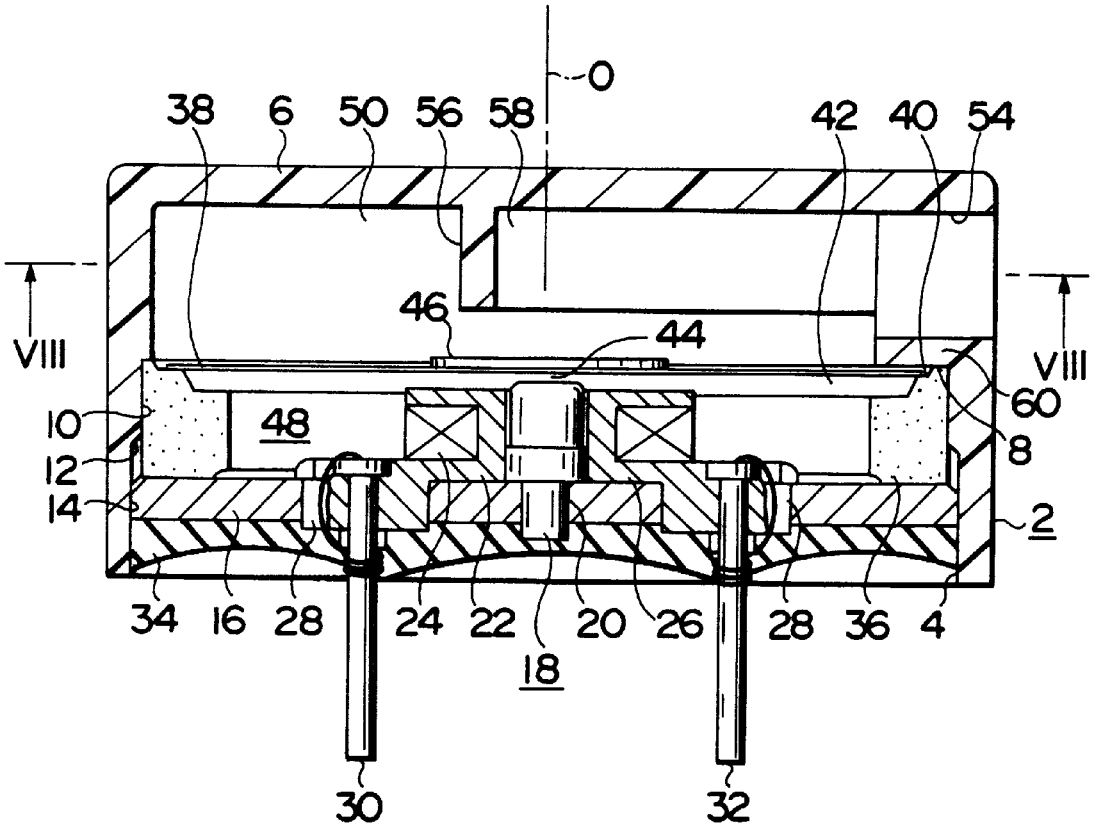
FIG. 7 is a longitudinal sectional view showing the fourth embodiment of an electroacoustic transducer according to the present invention.
Figure 8:
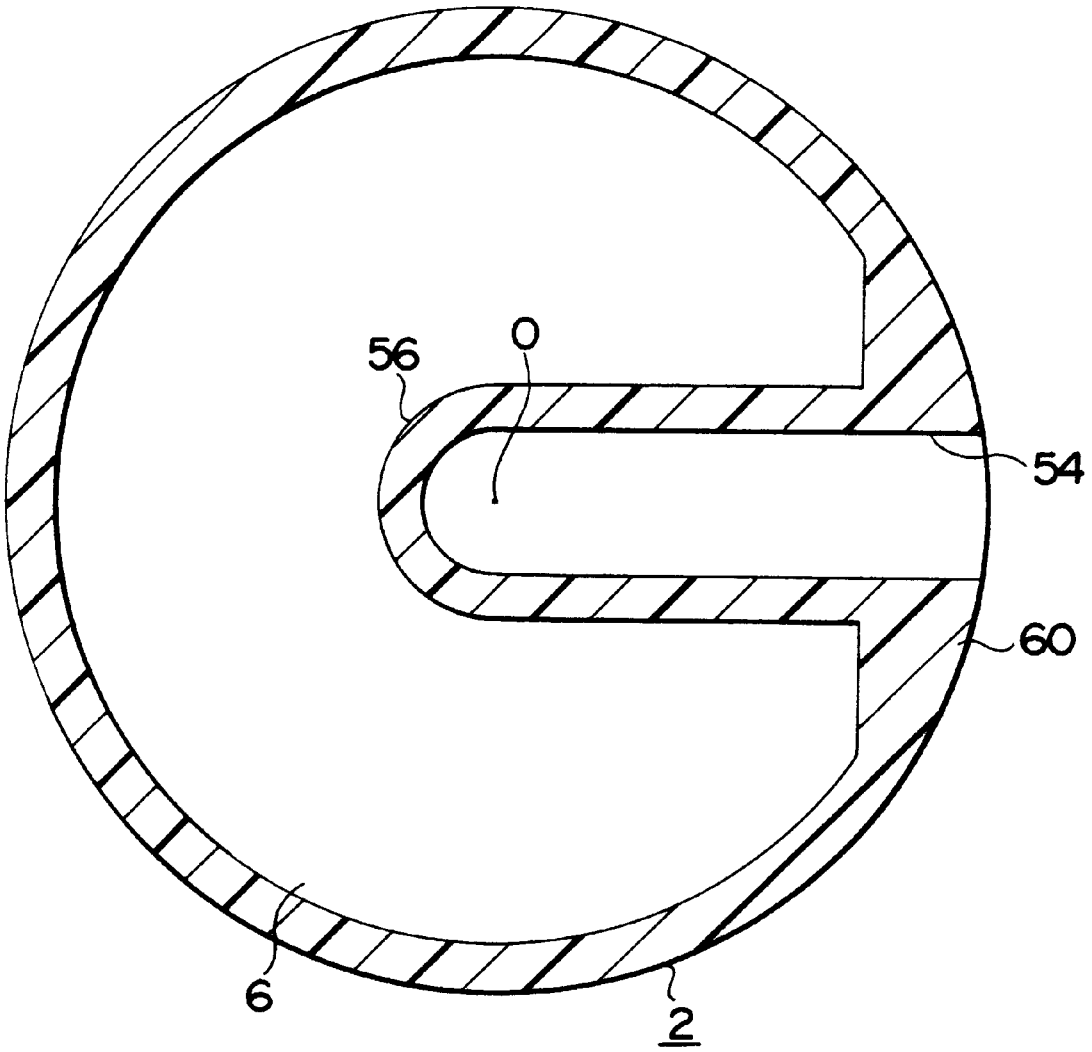
FIG. 8 is a sectional view taken on by the line VIII—VIII in the drawing of the electroacoustic transducer shown in FIG. 1.

Next, FIG. 7 and 8 illustrate the fourth embodiment of the electroacoustic transducer according to the present invention. In the electroacoustic transducer of this embodiment, a thickness part 60 is formed in the wall of the outer case 2 and the sound ejecting hole 54 is formed in the thickness part 60 in the direction perpendicular to the central axis O of the diaphragm 38; and the oval cylindrical rib 56 corresponding to the sound ejecting hole 54 is formed so as to surround the central axis of the diaphragm 38 and the sound ejecting hole 54 in the same manner as in the electroacoustic transducer of the third embodiment. With the sound ejecting hole 54 formed in this manner, the fourth embodiment will achieve a similar effect to the electroacoustic transducer of the third embodiment.

Figure 9:
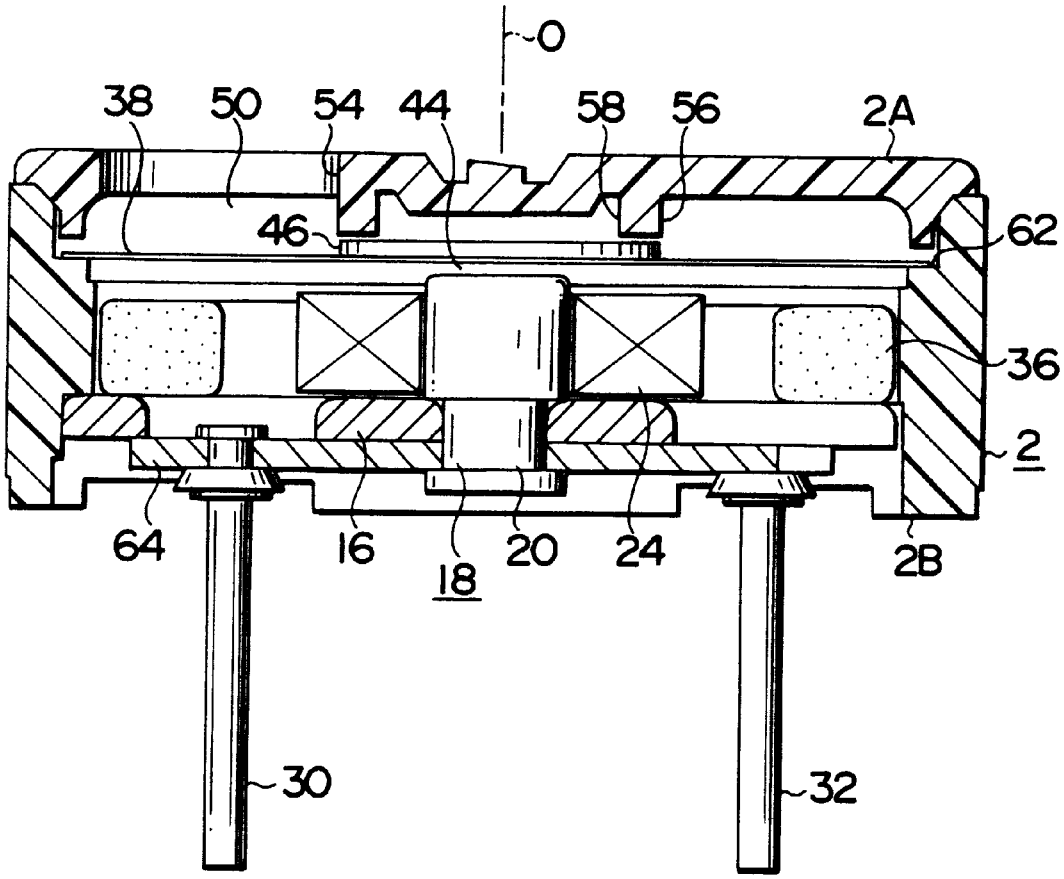
FIG. 9 is a longitudinal sectional view showing the fifth embodiment of an electroacoustic transducer according to the present invention.

Next, FIG. 9 illustrates the fifth embodiment of the electroacoustic transducer according to the present invention. In this electroacoustic transducer, the outer case 2 is separated into a lid 2A and a cylindrical trunk 2B to be formed in a flat shape. A stepped support part 62 is formed on the inner wall of the trunk 2B, on which the edge of the diaphragm 38 is mounted to support the diaphragm 38. An annular magnet 36 is placed inside the trunk 2B. Furthermore, the sound ejecting hole 54 is formed at a position deviated from the central axis O of the diaphragm 38, and the cylindrical rib 56 is formed to surround the central axis O. Further in this embodiment, a board 64 is mounted on the backside of the base 16, and the lead terminals 30, 32 are secured on the board 64.

Thus, in the electroacoustic transducer in which the lid 2A and the trunk 2B of the outer case 2 are constructed with separate members, the lid 2A does not have a sound ejecting cylinder but has the sound ejecting hole 54 only, and the cylindrical rib 56 is formed on the lid around the central axis of the diaphragm 38, the electroacoustic transducer will achieve a similar effect to the electroacoustic transducer of the foregoing embodiment.

Furthermore, in the aforementioned embodiments, the form of the rib 56 as the air damping means was an annular cylinder or oval cylinder, which, however, is not limited to being such, but it may be an angular cylinder.

Next, the characteristics of the electroacoustic transducer according to the present invention will be described.

The characteristics are measured in such a manner that, in a constant temperature (for example, 20° C.), the frequency of the pulse voltage in which the voltage is served as a parameter (1V, 3V, 5V, 7V) is continuously varied, the pressure of sound that the electroacoustic transducer emits is measured by a sound pressure meter, and the current is measured by varying the parameter of the voltage (for example, 4V, 5V, 6V).

Figure 10:
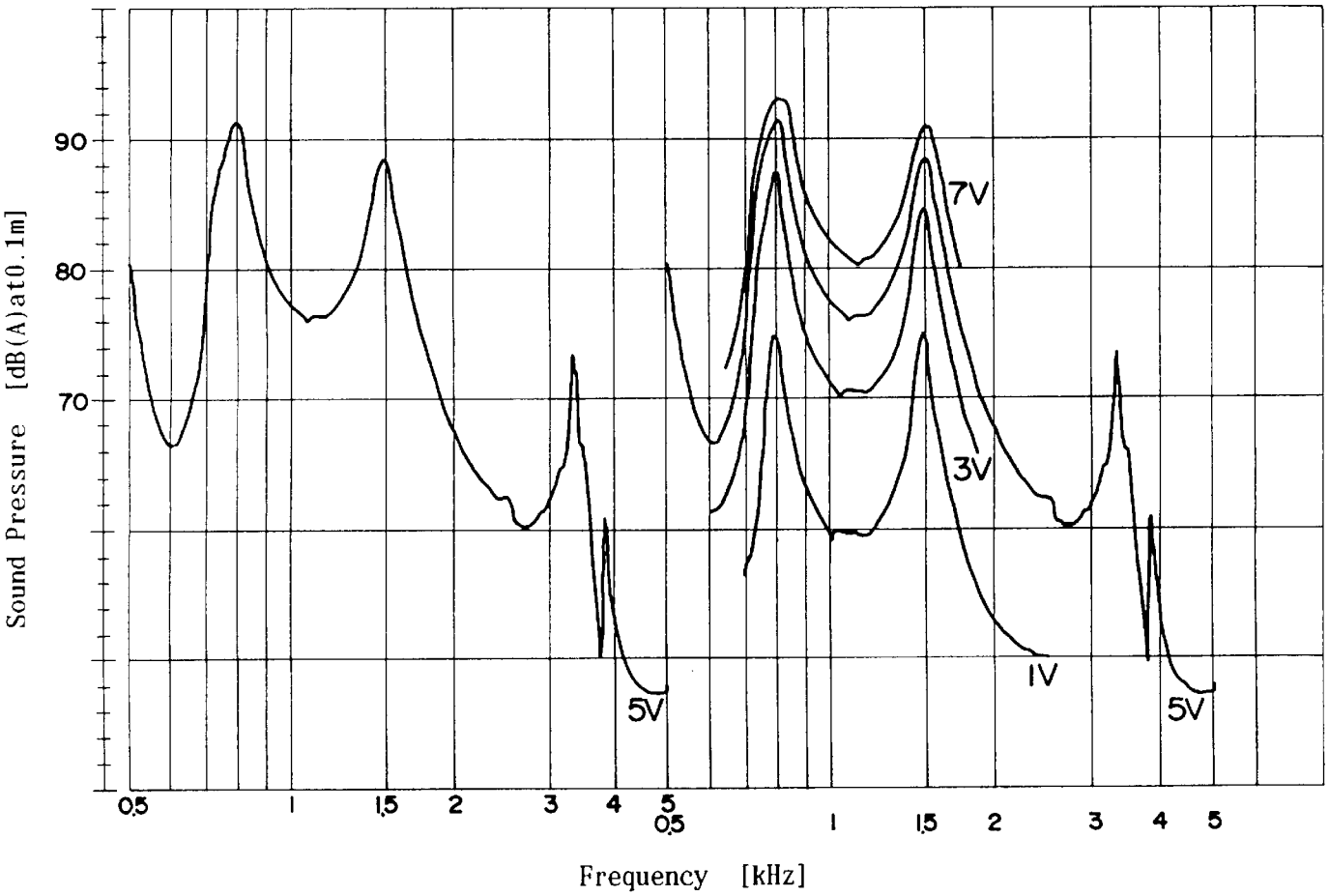
FIG. 10 is a graph showing a sound pressure vs. frequency response characteristics (overall) of the electroacoustic transducer shown in FIG. 3.
Figure 11:
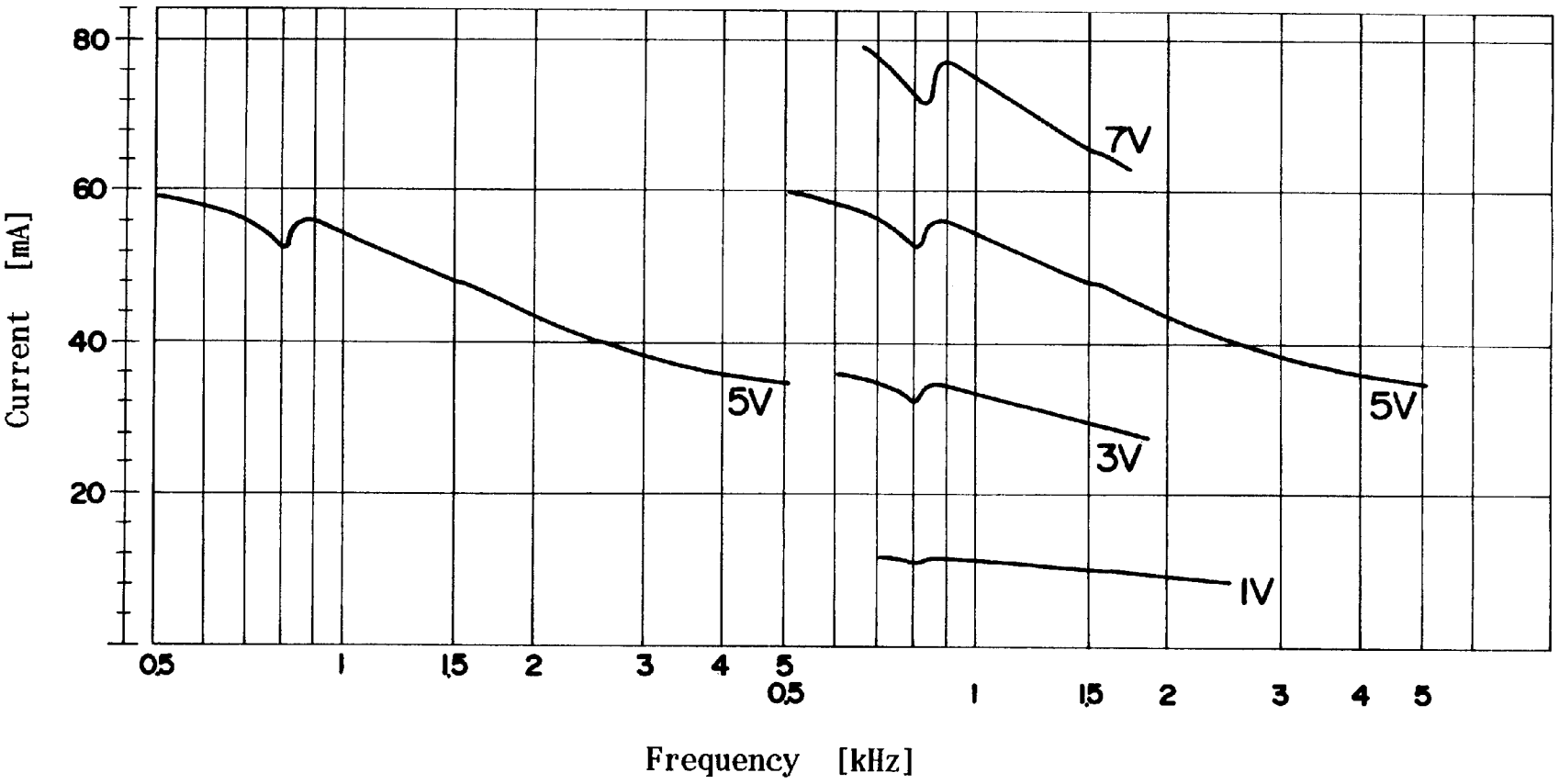
FIG. 11 is a graph showing a current vs. frequency response characteristics (overall) of the electroacoustic transducer shown in FIG. 3.
Figure 12:
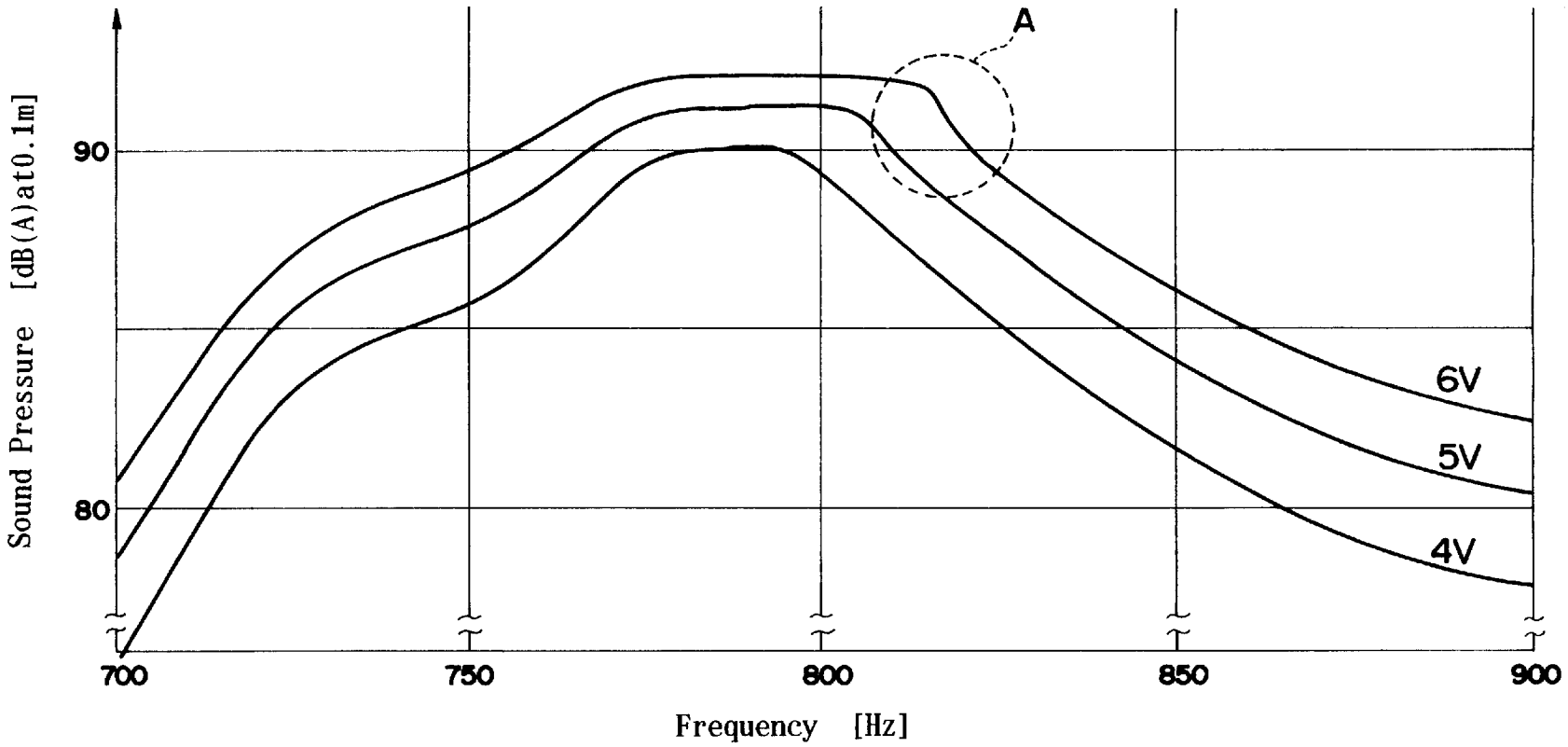
FIG. 12 is a graph showing a sound pressure VS. frequency response characteristics of the electroacoustic transducer shown in FIG. 3 near the frequency where the maximum response of the sound pressure is given.
Figure 13:
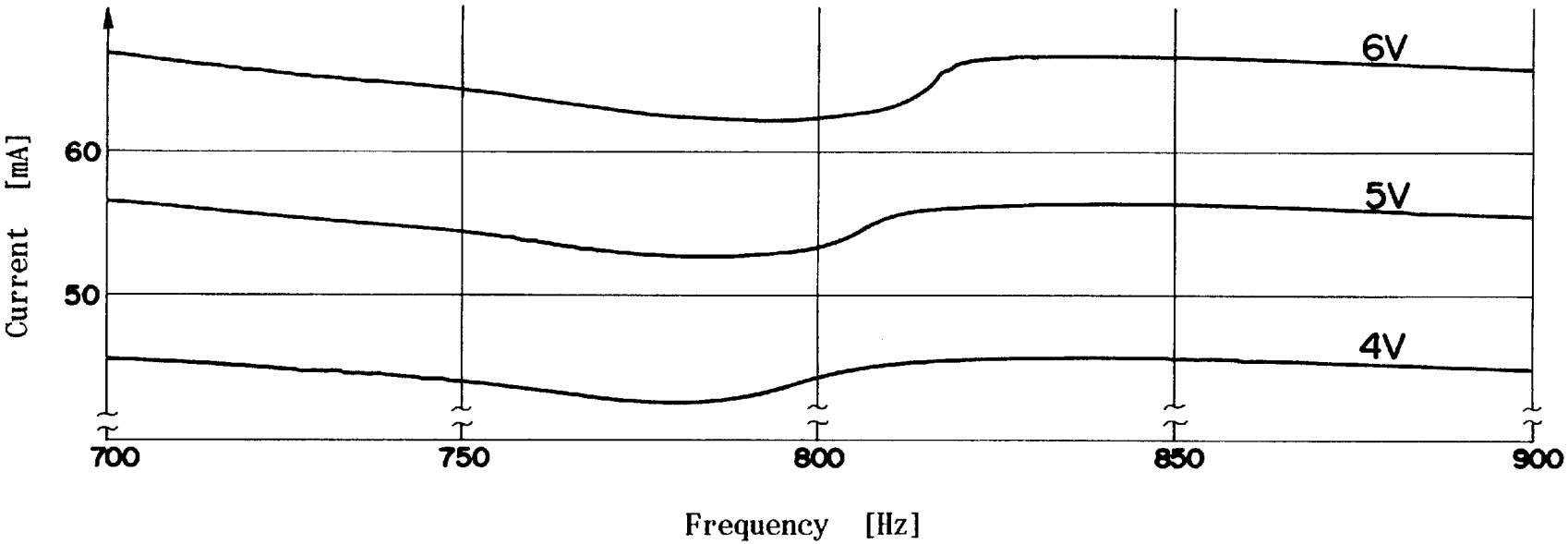
FIG. 13 is a graph showing a current VS. frequency response characteristics of the electroacoustic transducer shown in FIG. 3 near the frequency where the maximum response of the sound pressure is given.
Figure 14:
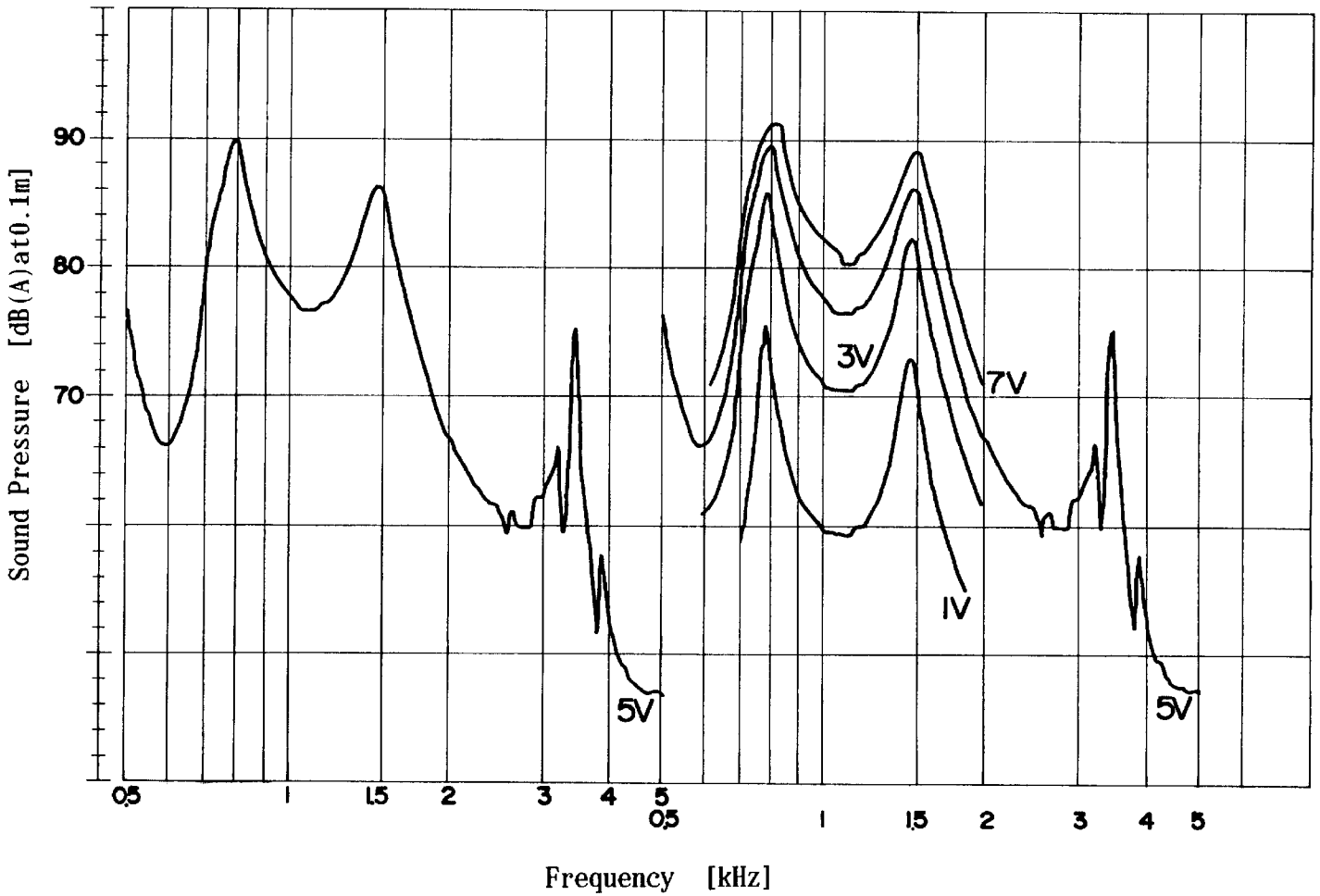
FIG. 14 is a graph showing a sound pressure vs. frequency response characteristics (overall) of the electroacoustic transducer shown in FIG. 7.
Figure 15:
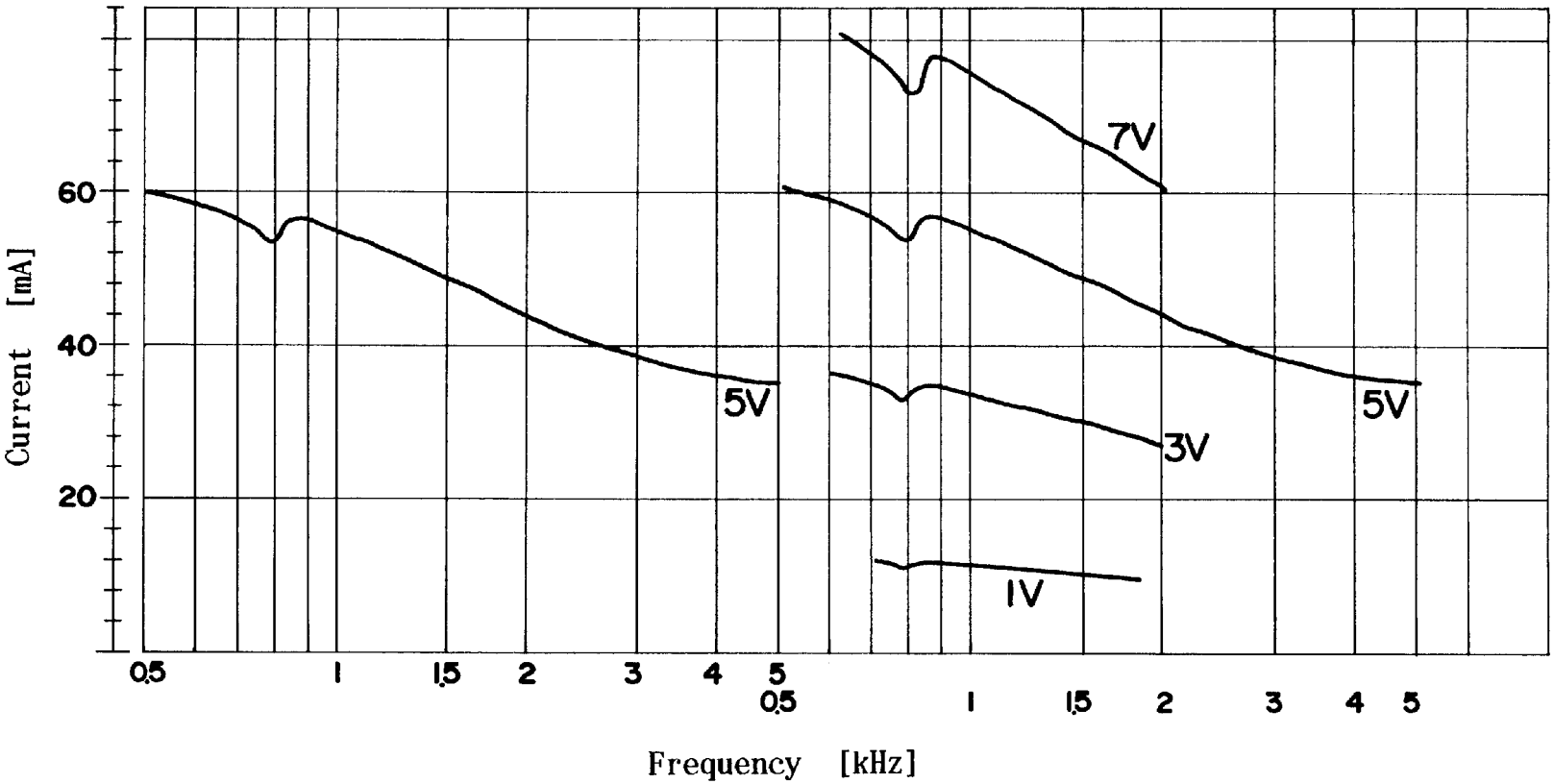
FIG. 15 is a graph showing a current vs. frequency response characteristics (overall) of the electroacoustic transducer shown in FIG. 7.
Figure 16:
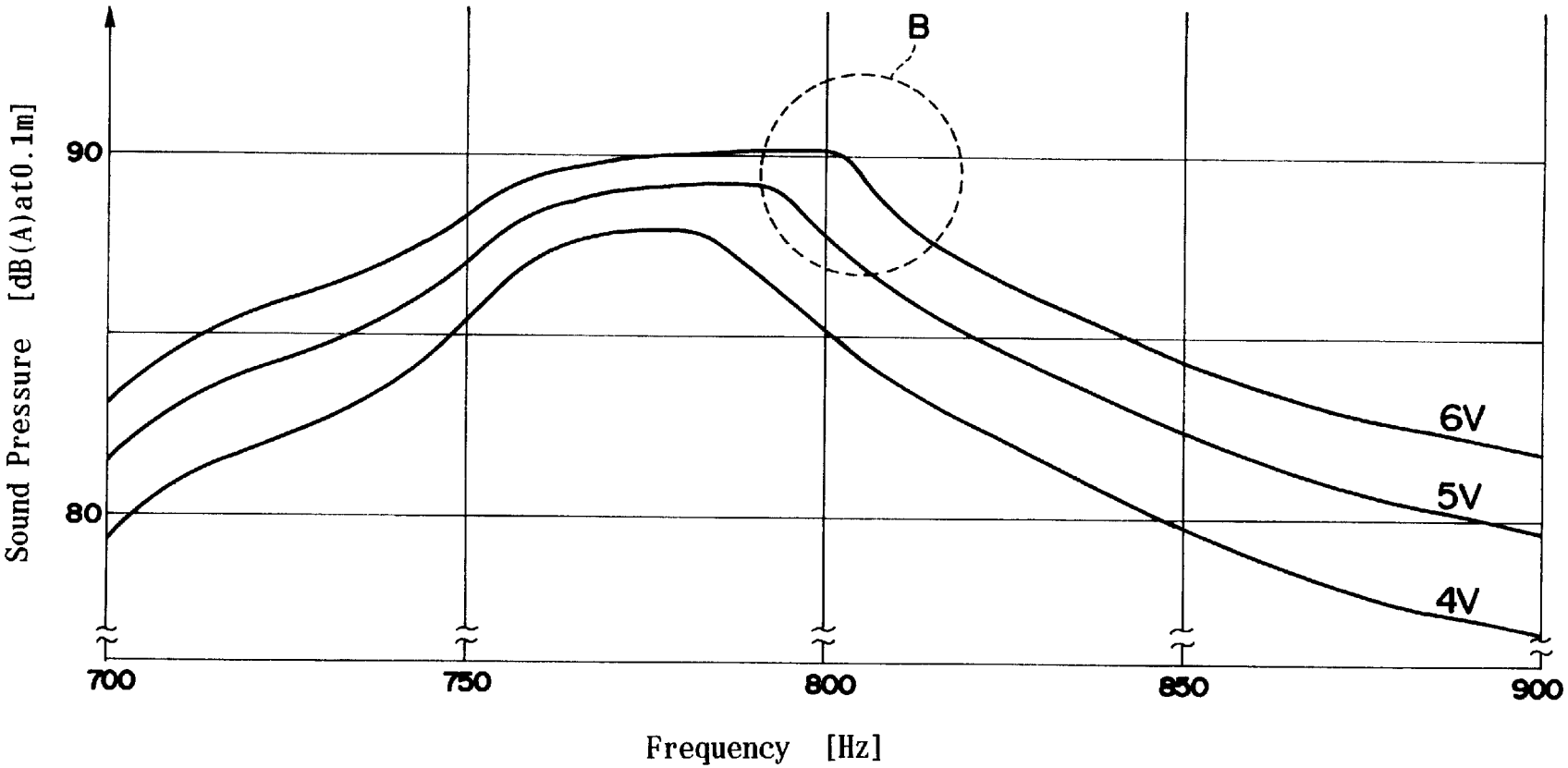
FIG. 16 is a graph showing a sound pressure VS. frequency response characteristics of the electroacoustic transducer shown in FIG. 7 near the frequency where the maximum response of the sound pressure is given.
Figure 17:
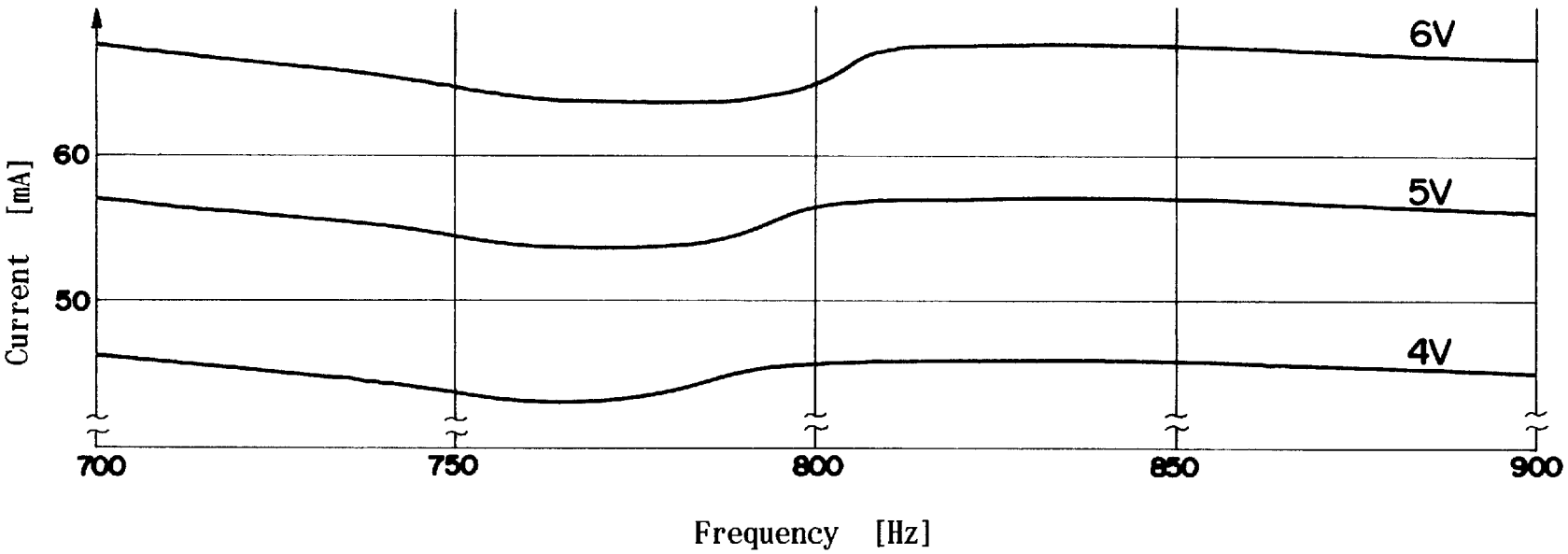
FIG. 17 is a graph showing a current VS. frequency response characteristics of the electroacoustic transducer shown in FIG. 7 near the frequency where the maximum response of the sound pressure is given.
Figure 18:
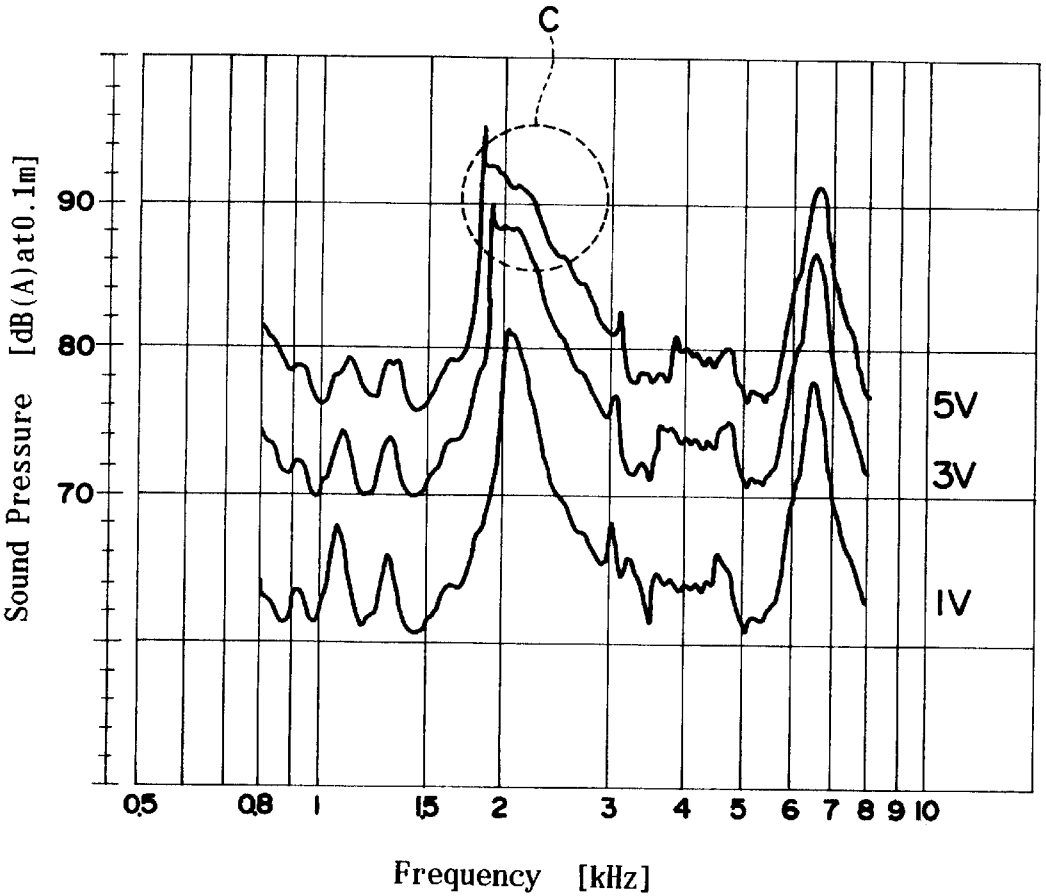
FIG. 18 is a graph showing a sound pressure vs. frequency response characteristics (overall) of the electroacoustic transducer shown in FIG. 9.
Figure 19:
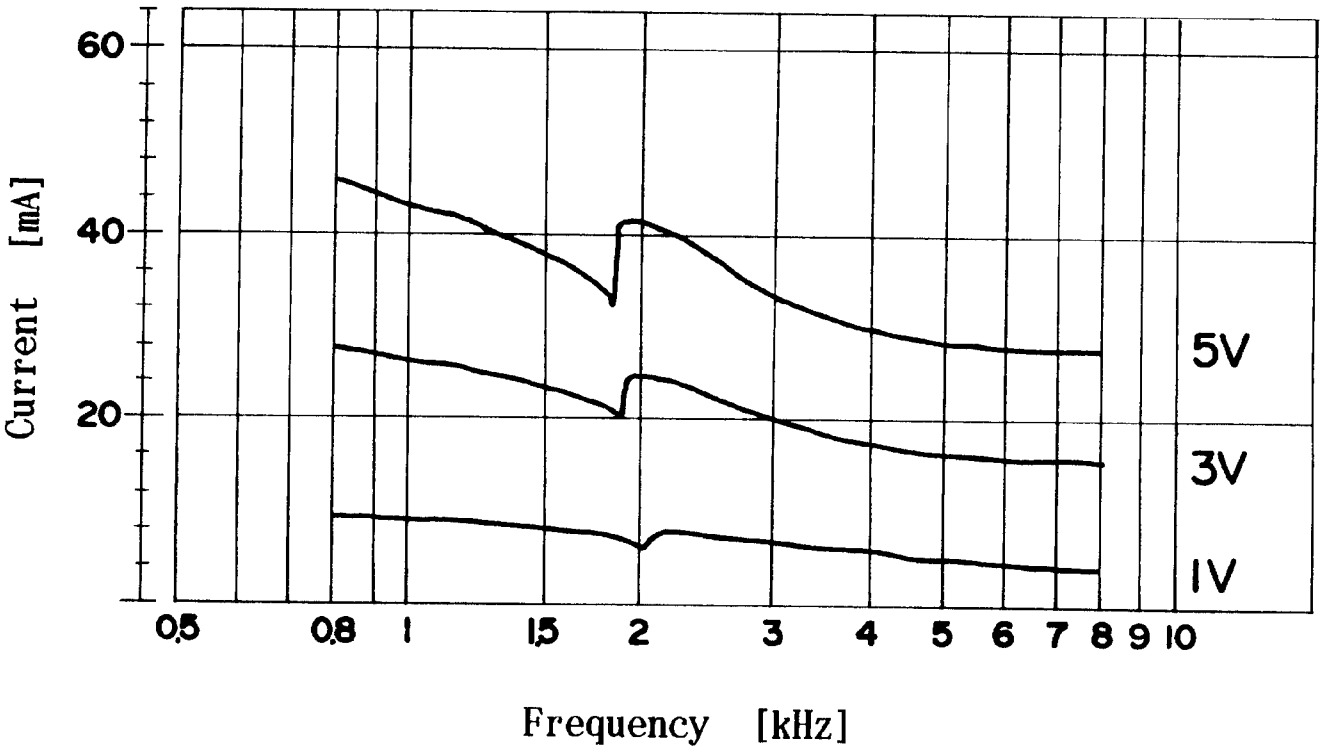
FIG. 19 is a graph showing a current vs. frequency response characteristics (overall) of the electroacoustic transducer shown in FIG. 9.
Figure 20:
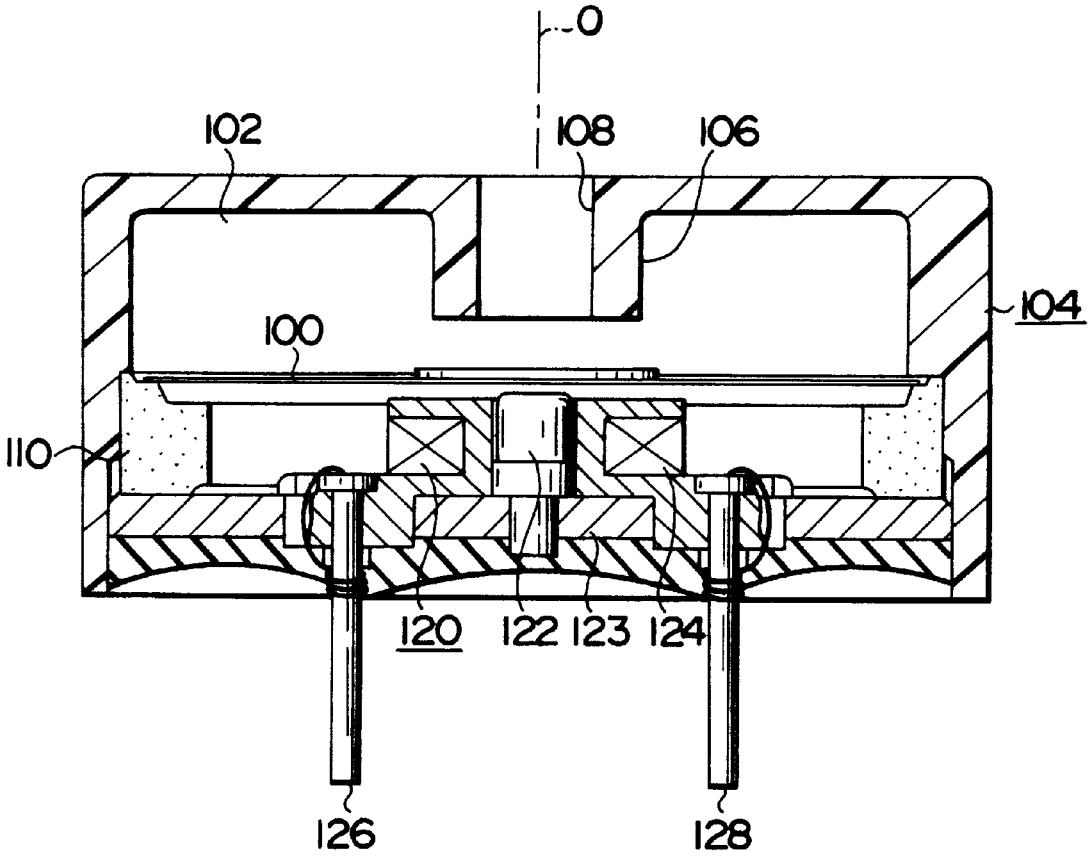
PRIOR ART FIG. 20
FIG. 20 is a longitudinal sectional view showing a conventional electroacoustic transducer.
Figure 21:
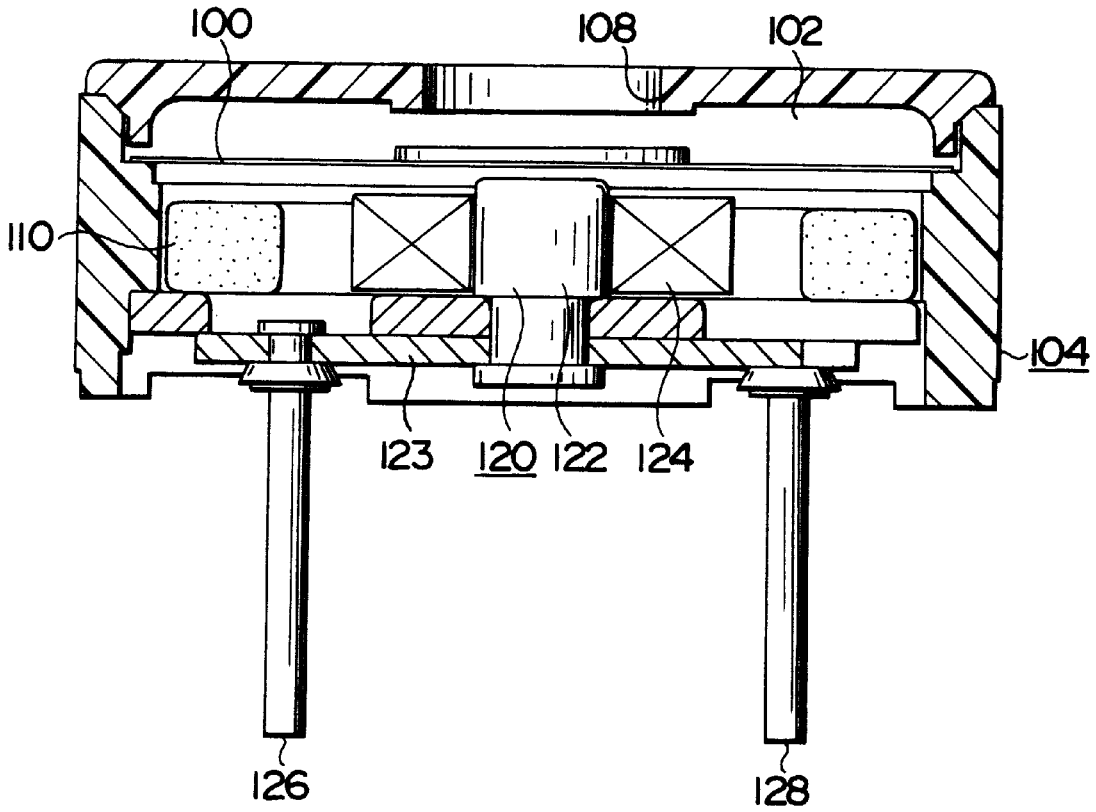
PRIOR ART FIG. 21
FIG. 21 is a longitudinal sectional view showing another conventional electroacoustic transducer.
Figure 22:
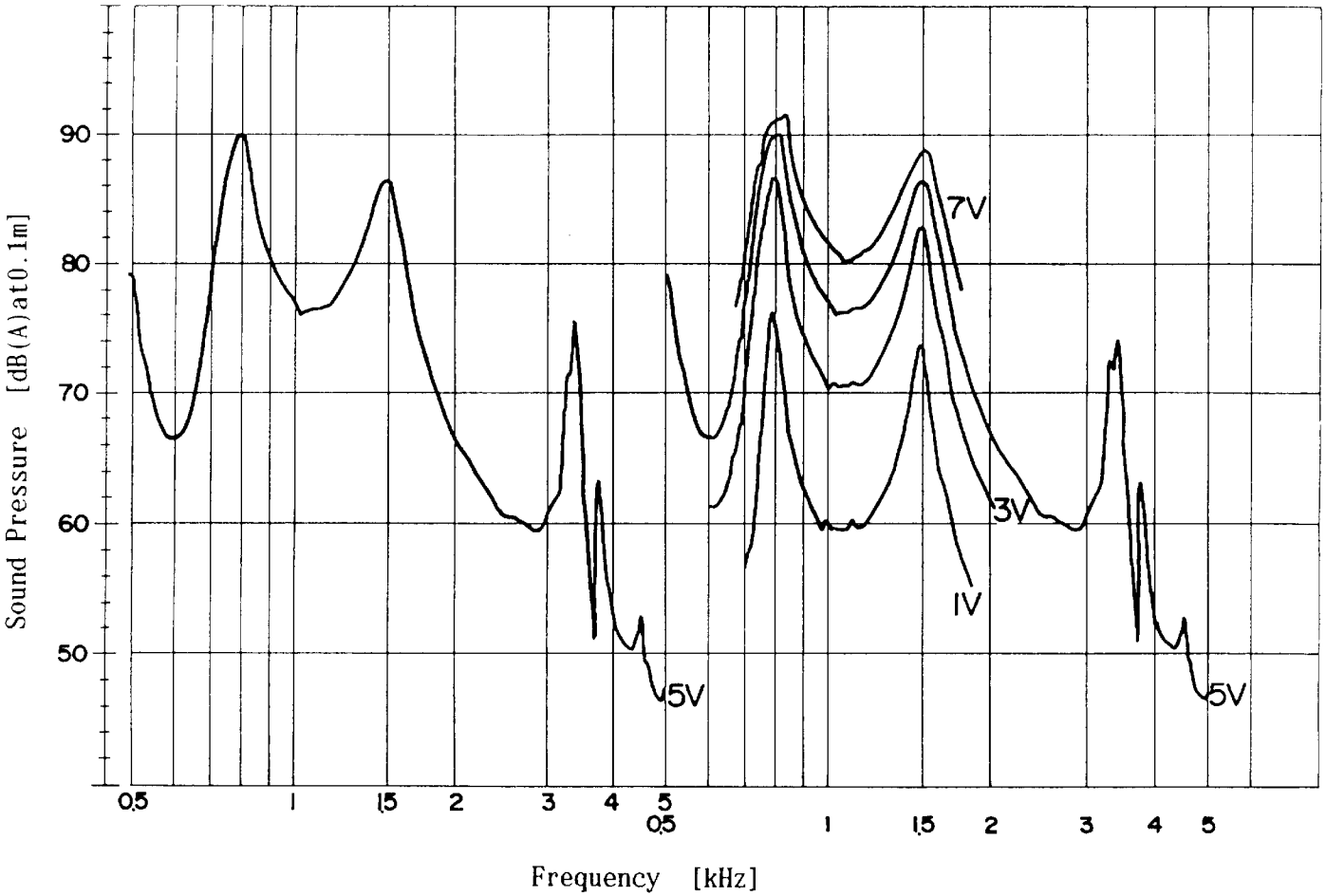
PRIOR ART FIG. 22
FIG. 22 is a graph showing a sound pressure vs. frequency response characteristics (overall) of the electroacoustic transducer shown in FIG. 20.
Figure 23:
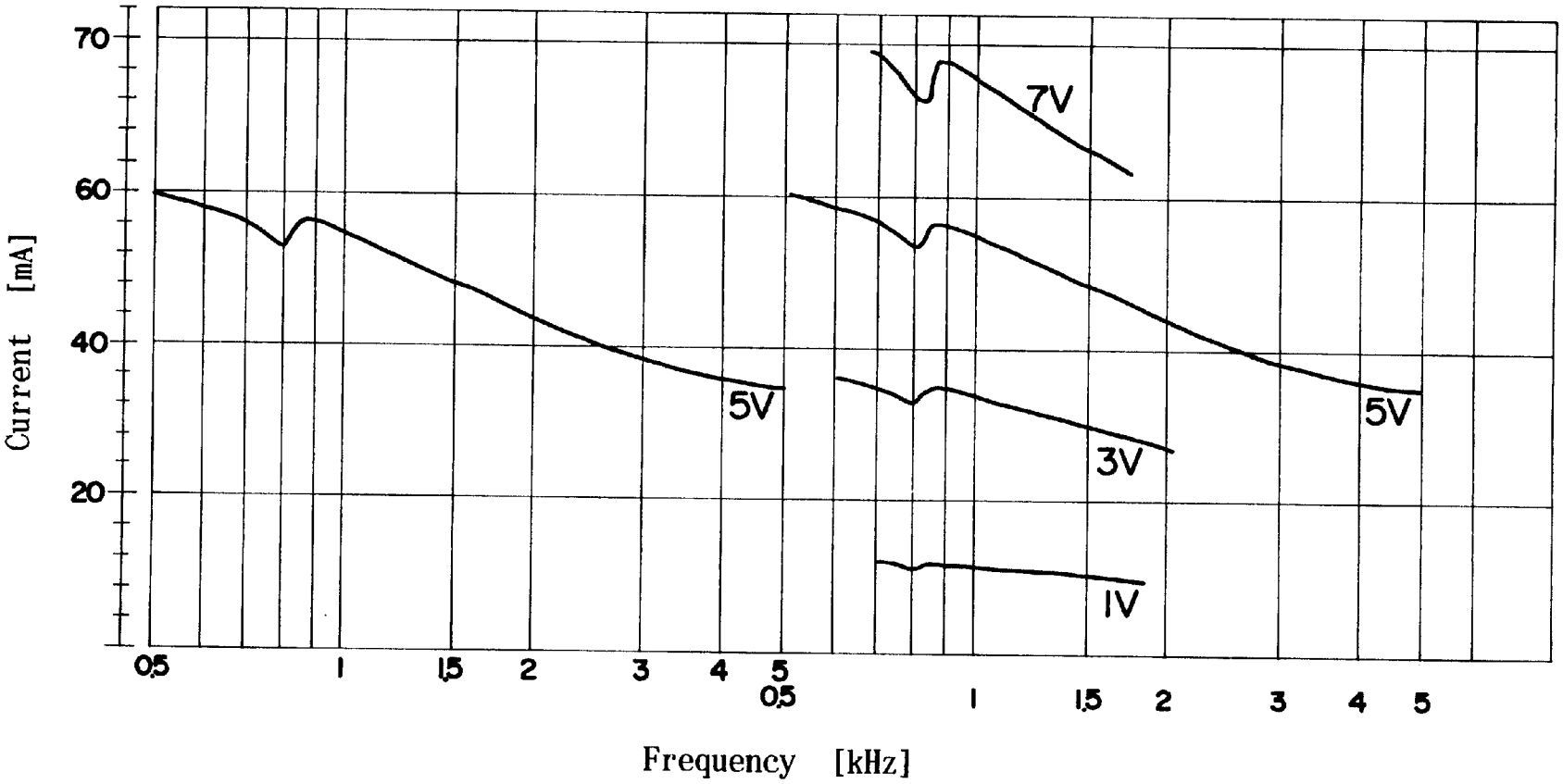
PRIOR ART FIG. 23
FIG. 23 is a graph showing a current vs. frequency response characteristics (overall) of the electroacoustic transducer shown in FIG. 20.
Figure 24:
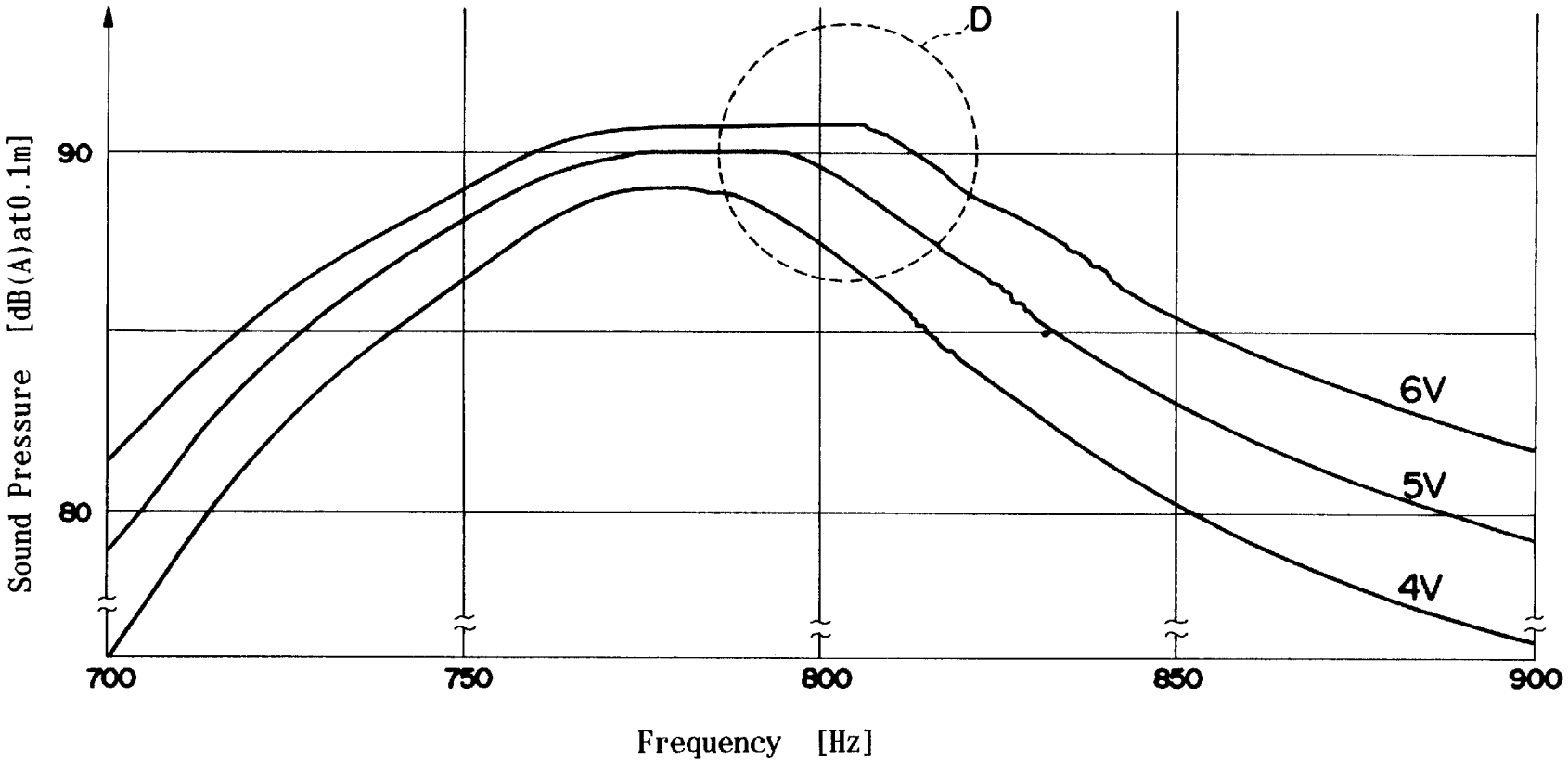
PRIOR ART FIG. 24
FIG. 24 is a graph showing a sound pressure VS. frequency response characteristics of the electroacoustic transducer shown in FIG. 20 near the frequency where the maximum response of the sound pressure is given.
Figure 25:
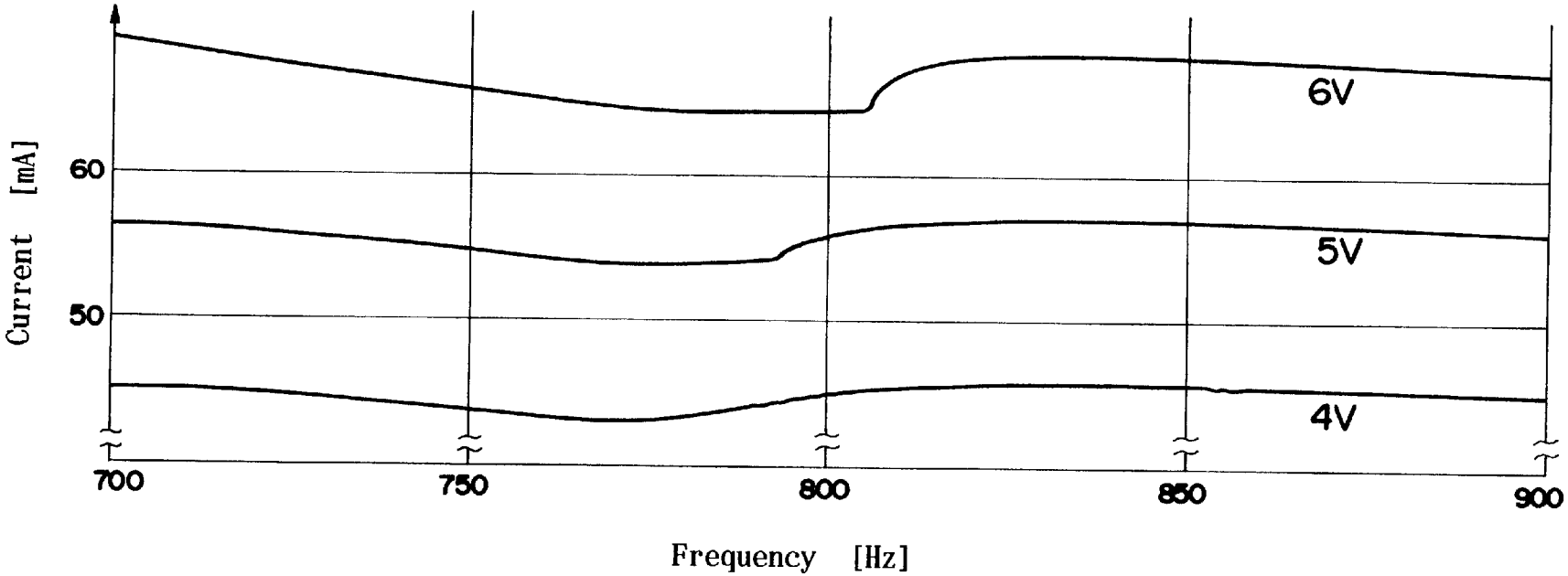
PRIOR ART FIG. 25
FIG. 25 is a graph showing a current VS. frequency response characteristics of the electroacoustic transducer shown in FIG. 20 near the frequency where the maximum response of the sound pressure is given.
Figure 26:
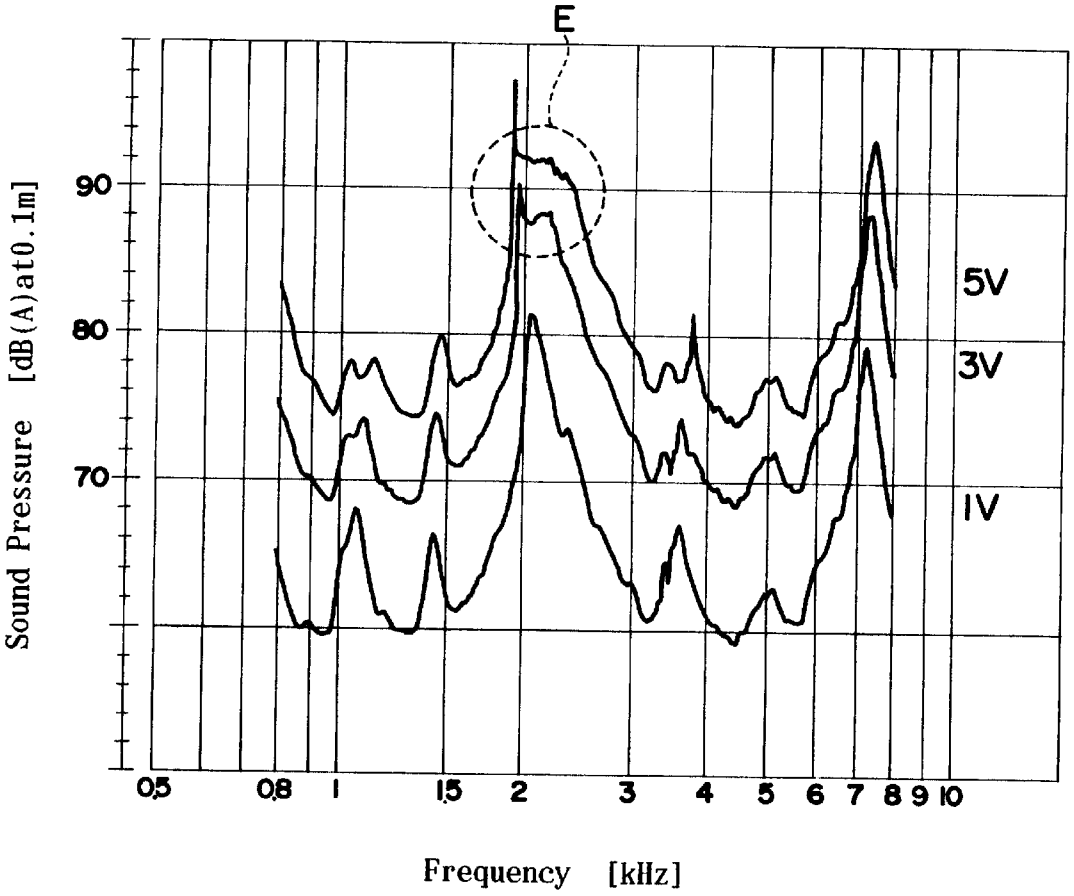
PRIOR ART FIG. 26
FIG. 26 is a graph showing a sound pressure vs. frequency response characteristics (overall) of the electroacoustic transducer shown in FIG. 21.
Figure 27:
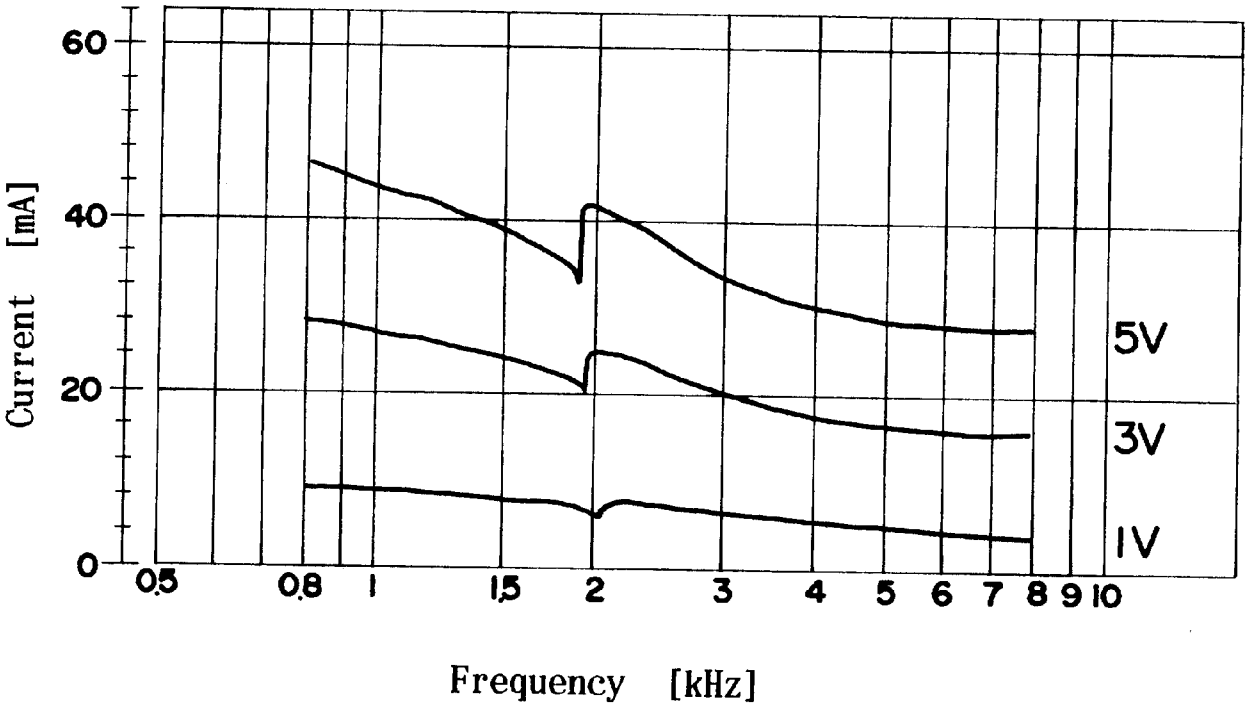
PRIOR ART FIG. 27
FIG. 27 is a graph showing a current vs. frequency response characteristics (overall) of the electroacoustic transducer shown in FIG. 21.
Figure 28:
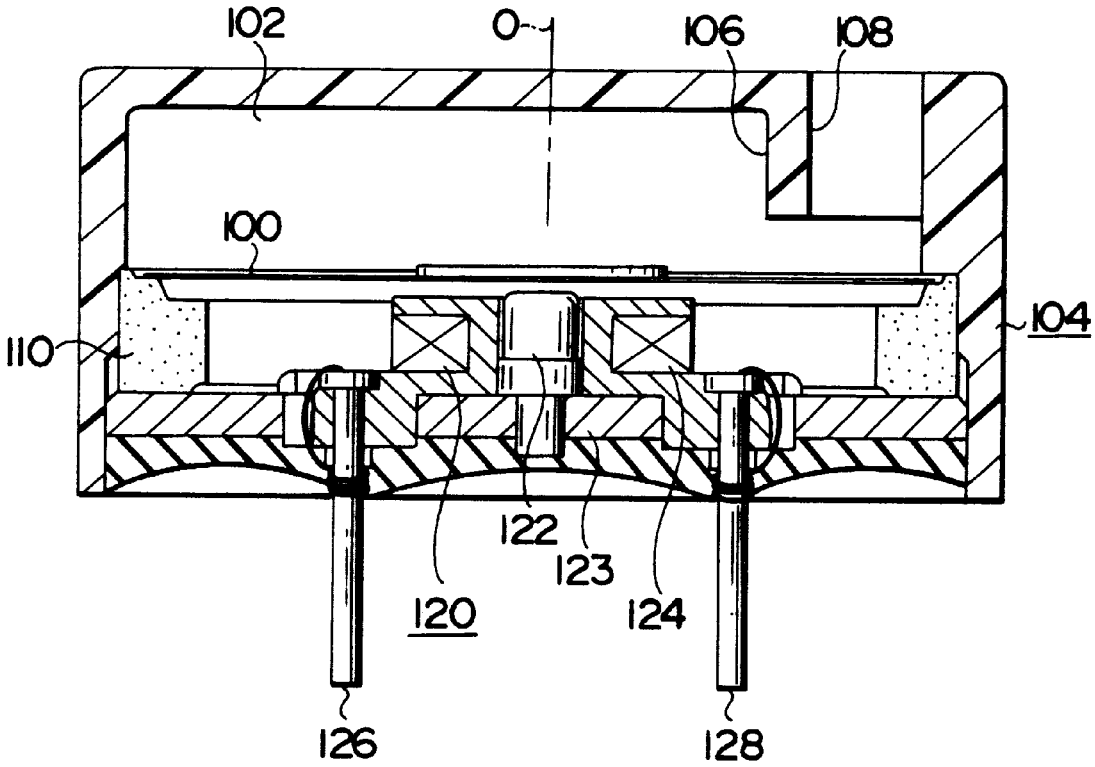
PRIOR ART FIG. 28
FIG. 28 is a longitudinal sectional view showing another conventional electroacoustic transducer.
Figure 29:
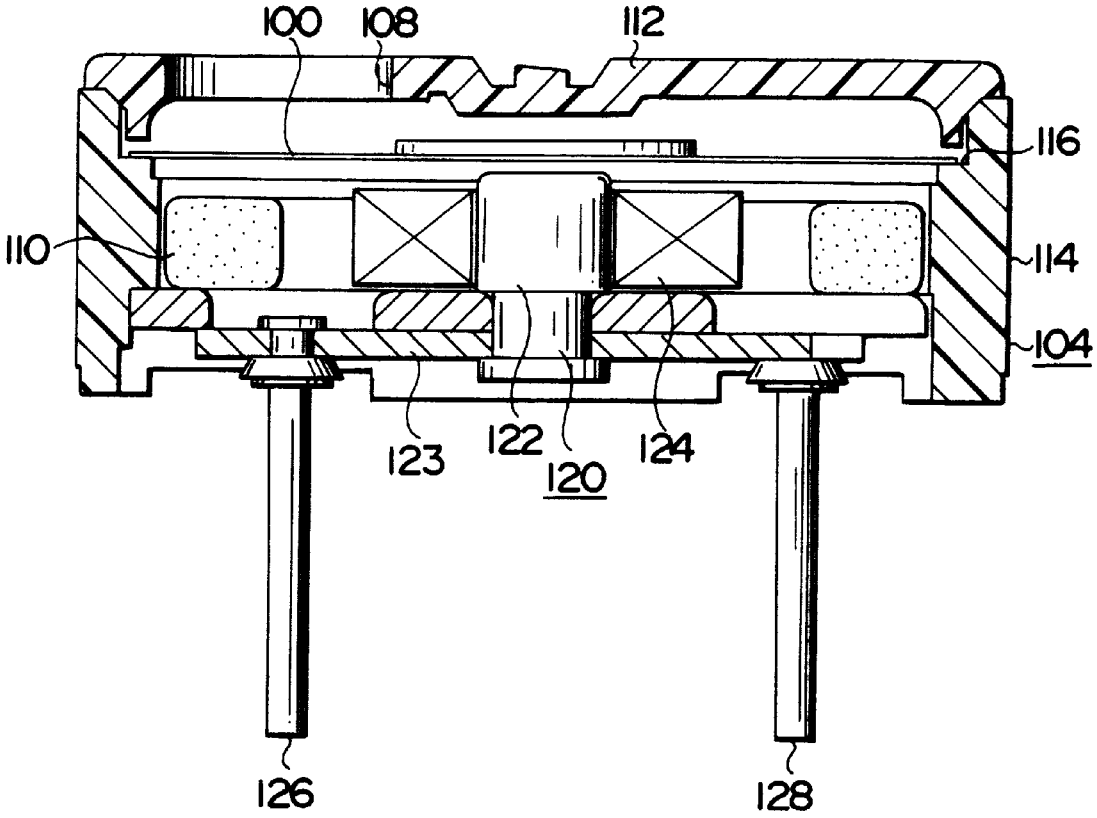
PRIOR ART FIG. 29
FIG. 29 is a longitudinal sectional view showing another conventional electroacoustic transducer.

FIG. 10 shows frequency response characteristics of the sound pressure of the electroacoustic transducer shown in FIG. 3; FIG. 11 shows frequency response characteristics of the current; FIG. 12 shows frequency response characteristics of the sound pressure near the frequency where the maximum response of the sound pressure is given; FIG. 13 shows frequency response characteristics of the current near the frequency where the maximum response of the sound pressure is given. In FIG. 12, the characteristics near A part becomes gentle and smooth, showing that chatterings do not occur. FIG. 14 shows frequency response characteristics of the sound pressure of the electroacoustic transducer shown in FIG. 7; FIG. 15 shows frequency response characteristics of the current; FIG. 16 shows frequency response characteristics of the sound pressure near the frequency where the maximum response of the sound pressure is given; FIG. 17 shows frequency response characteristics of the current near the frequency where the maximum response of the sound pressure is given. In FIG. 16, the characteristics near B part becomes gentle and smooth, showing that no chatterings occur whatsoever. FIG. 18 shows frequency response characteristics of the sound pressure of the electroacoustic transducer shown in FIG. 9; FIG. 19 shows frequency response characteristics of the current. In FIG.18, the characteristics near C part is seen that the peak is suppressed.

Figure 30:
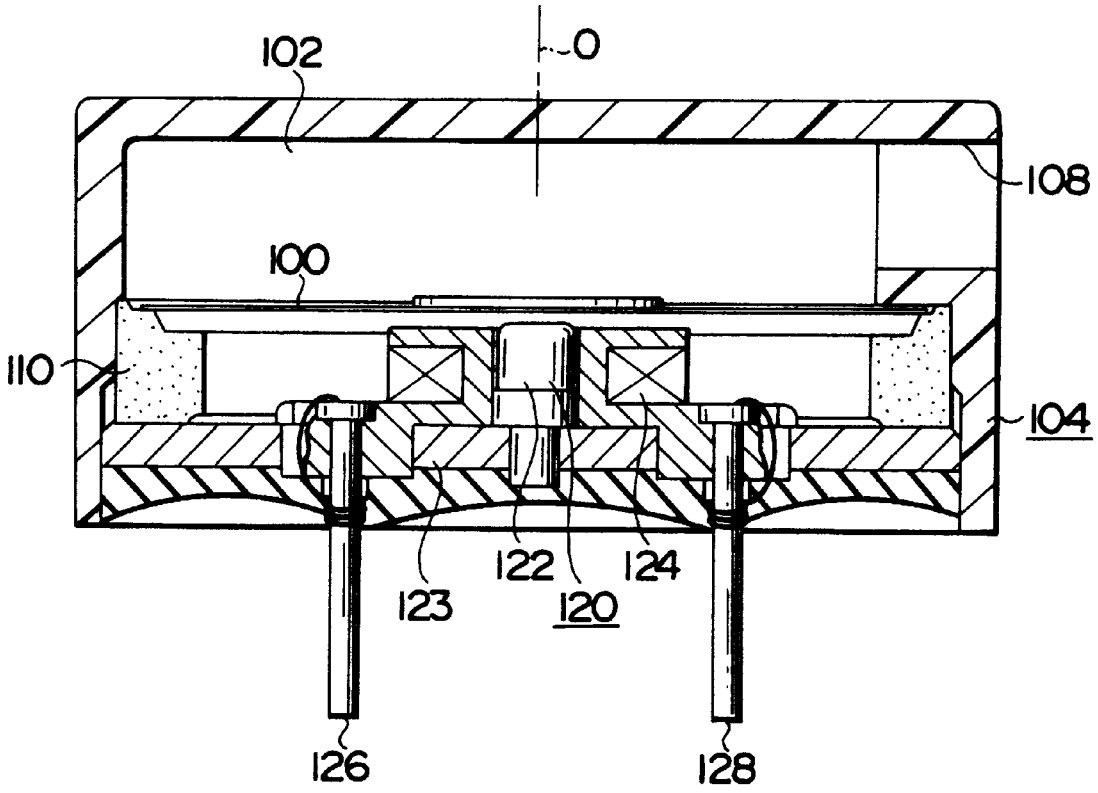
PRIOR ART FIG. 30
FIG. 30 is a longitudinal sectional view showing another conventional electroacoustic transducer.
Figure 31:
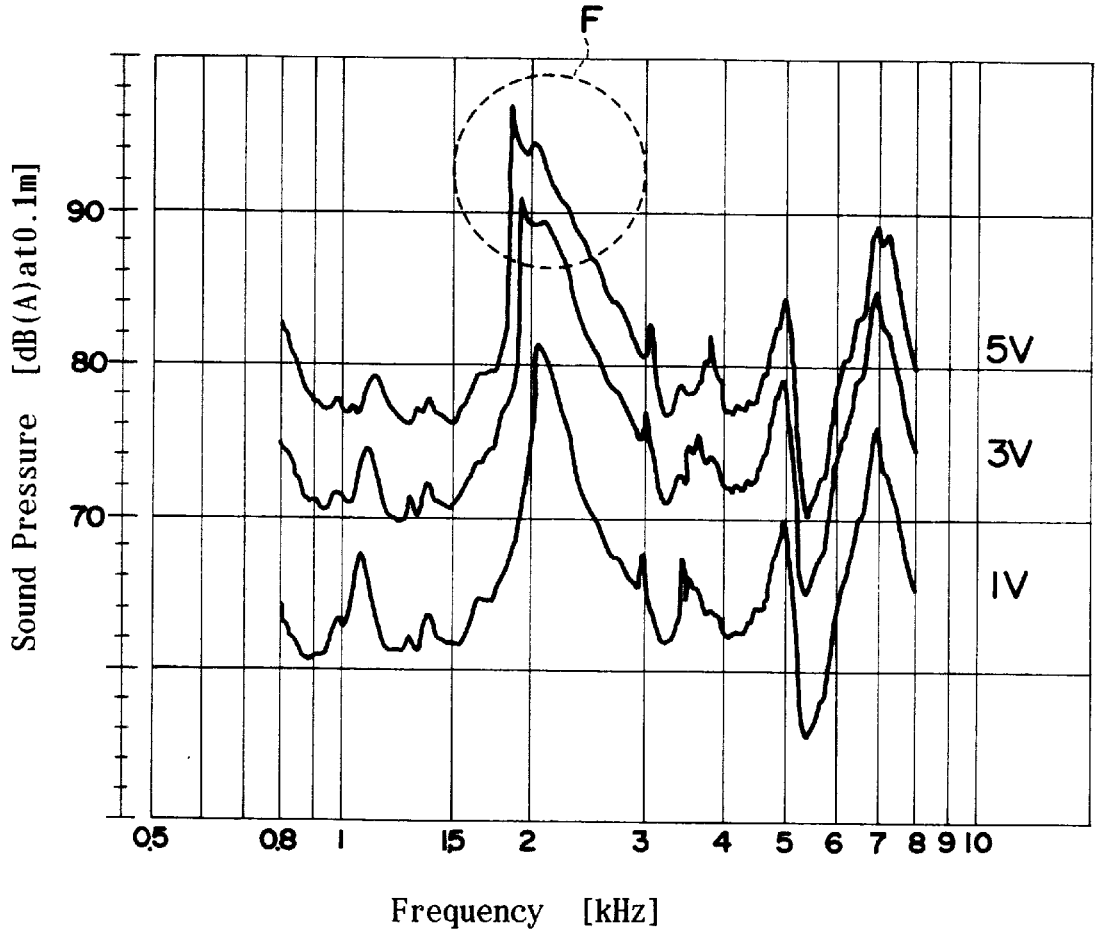
PRIOR ART FIG. 31
FIG. 31 is a graph showing a sound pressure vs. frequency response characteristics (overall) of the electroacoustic transducer shown in FIG. 29.
Figure 32:
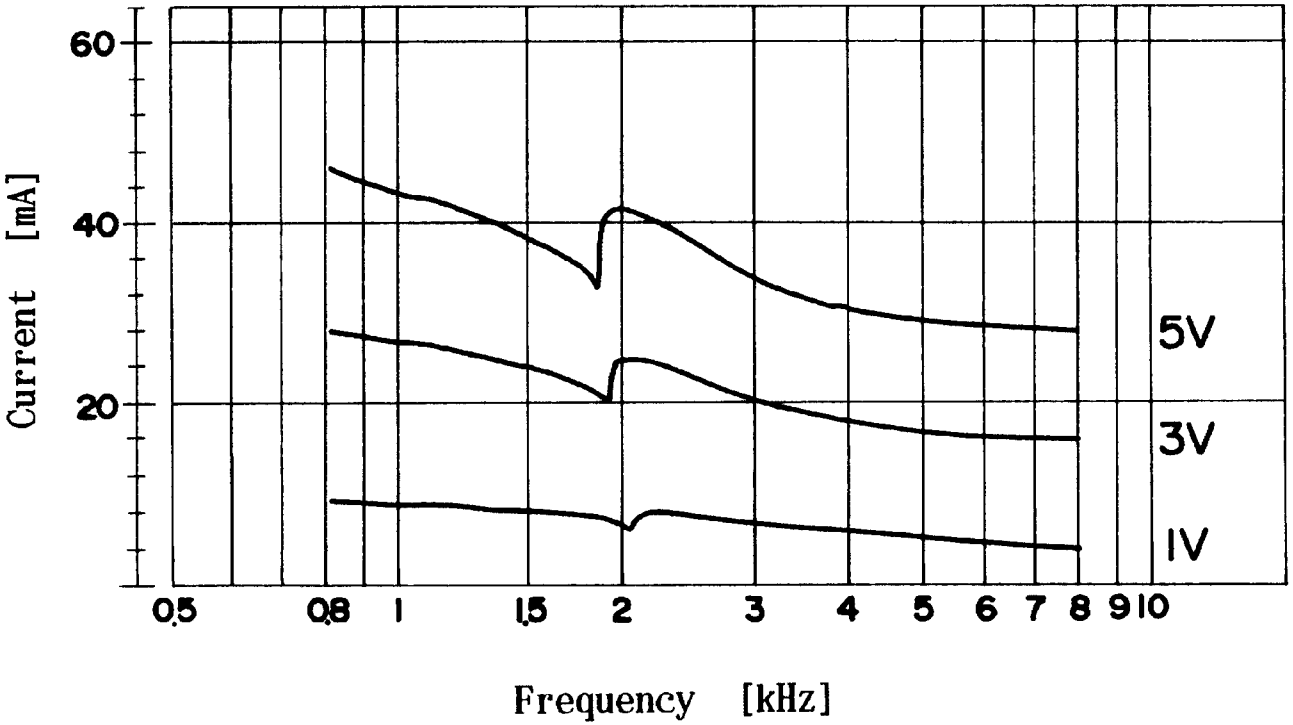
PRIOR ART FIG. 32
FIG. 32 is a graph showing a current vs. frequency response characteristics (overall) of the electroacoustic transducer shown in FIG. 29.
Figure 33:
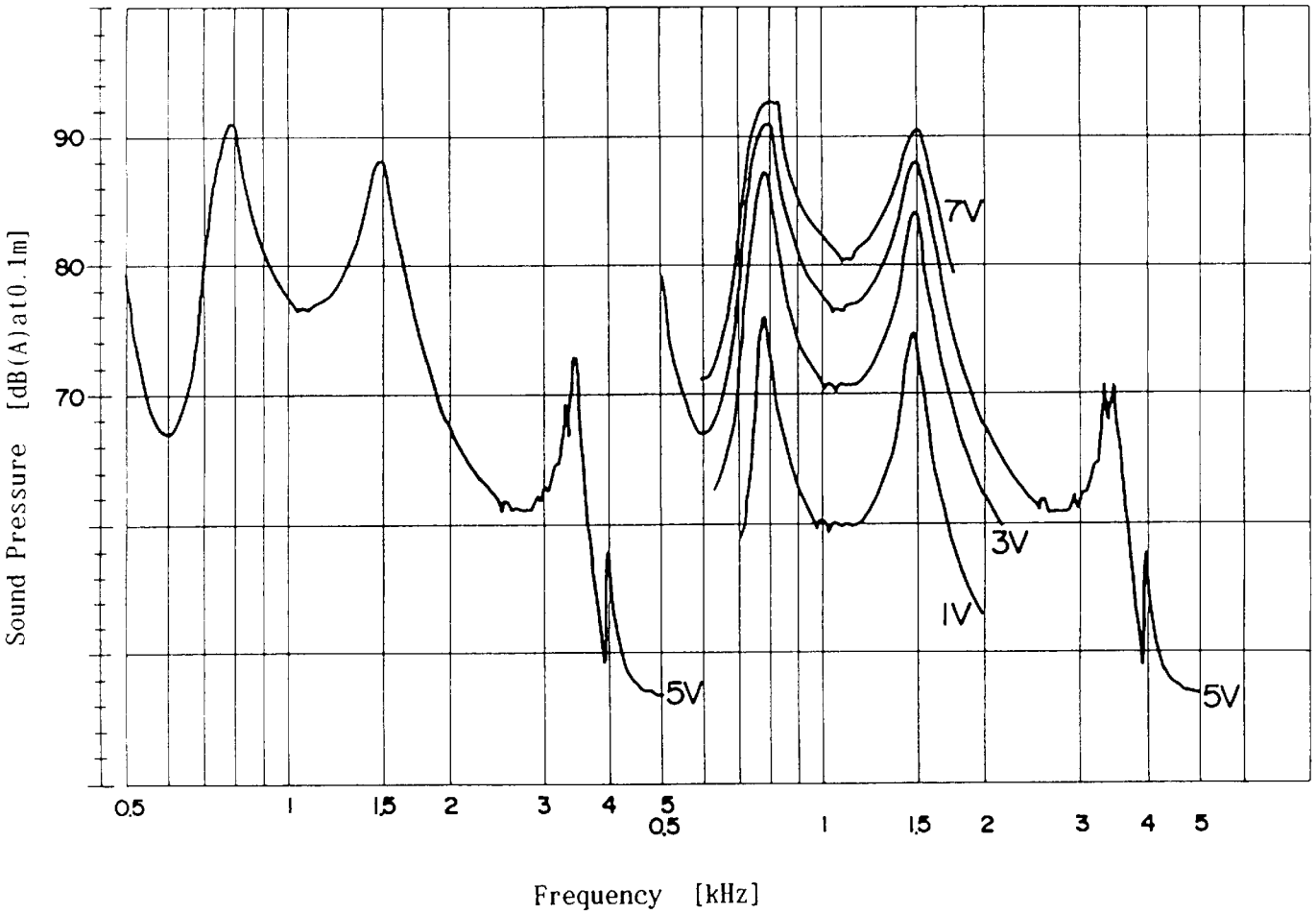
PRIOR ART FIG. 33
FIG. 33 is a graph showing a sound pressure vs. frequency response characteristics (overall) of the electroacoustic transducer shown in FIG. 30.
Figure 34:
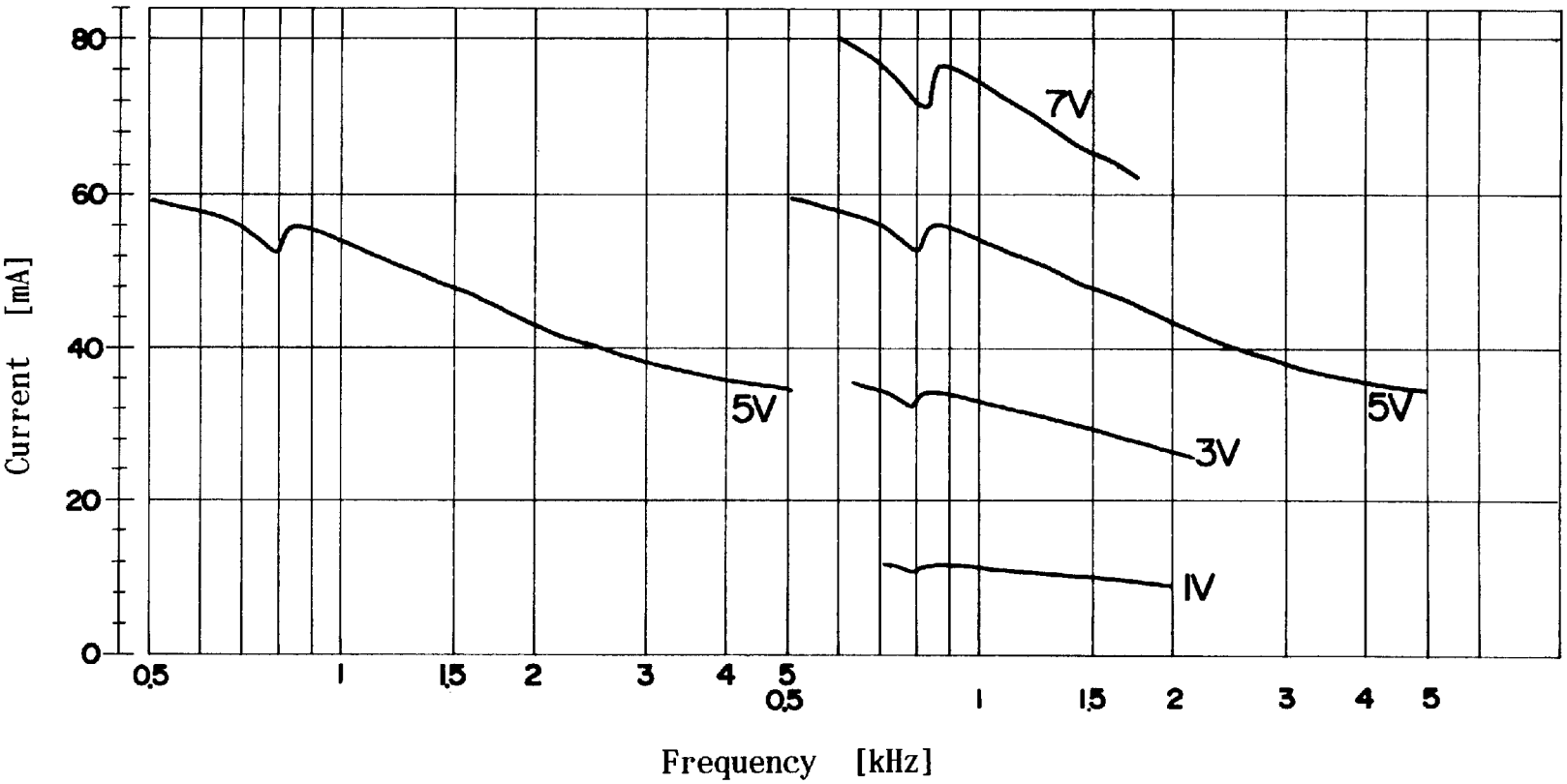
PRIOR ART FIG. 34
FIG. 34 is a graph showing a current vs. frequency response characteristics (overall) of the electroacoustic transducer shown in FIG. 30.
Figure 35:
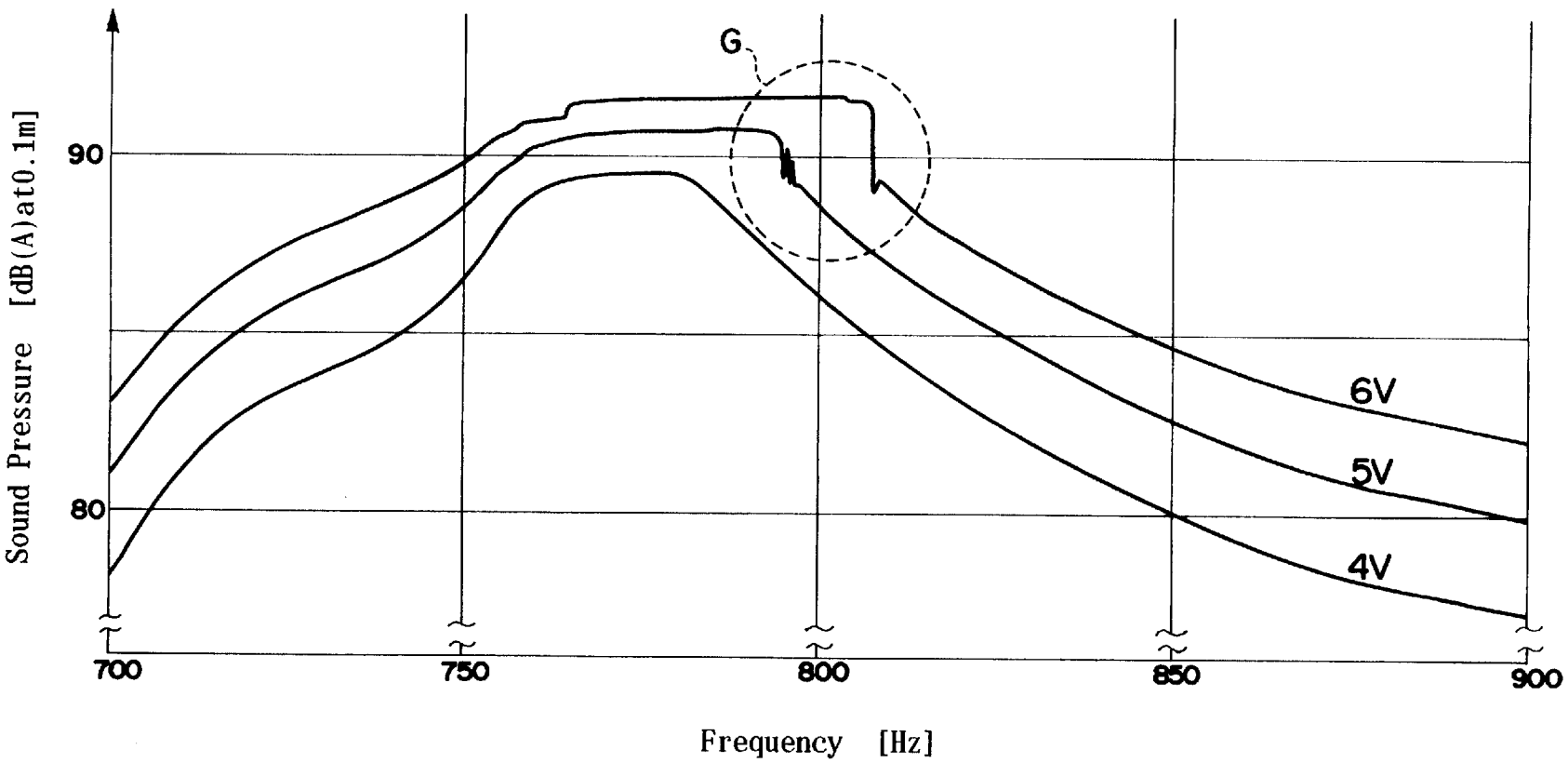
PRIOR ART FIG. 35
FIG. 35 is a graph showing a sound pressure VS. frequency response characteristics of the electroacoustic transducer shown in FIG. 30 near the frequency where the maximum response of the sound pressure is given.
Figure 36:
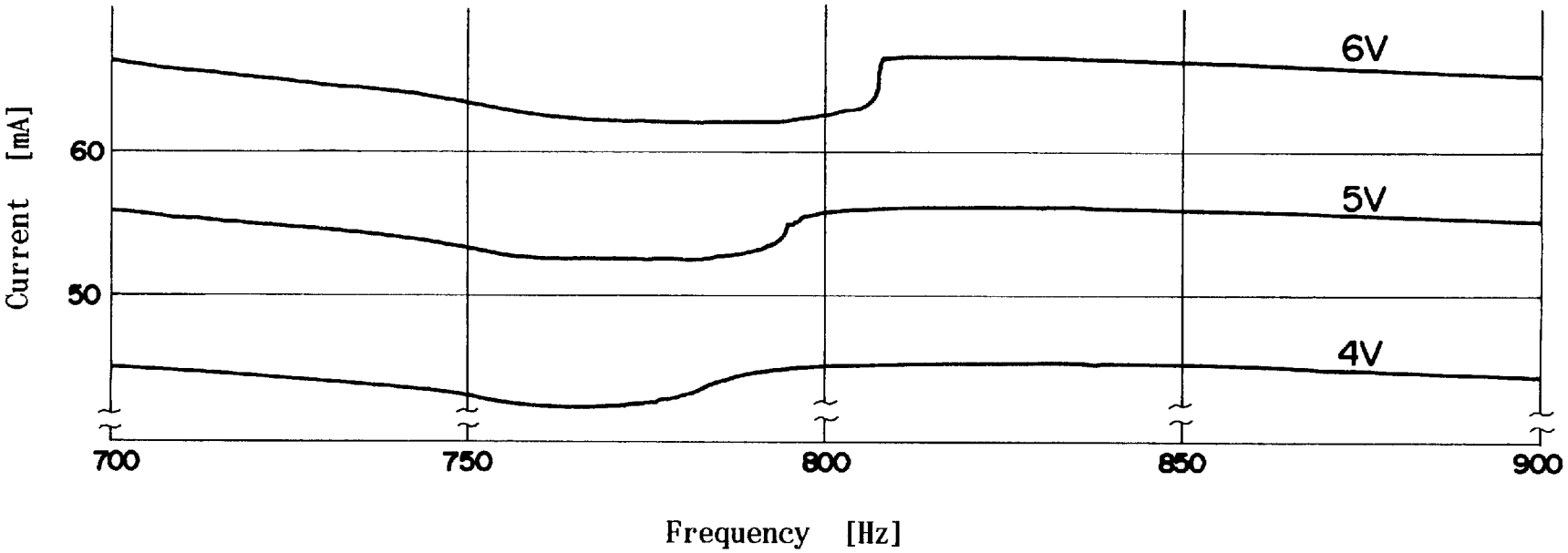
PRIOR ART FIG. 36
FIG. 36 is a graph showing a current VS. frequency response characteristics of the electroacoustic transducer shown in FIG. 30 near the frequency where the maximum response of the sound pressure is given.

As clearly seen in these results, when the sound ejecting part 52 and sound ejecting hole 54 are formed at a deviated position from the central axis O of the diaphragm 38 in the electroacoustic transducer, the air damping effect is achieved by forming the cylindrical rib 56 around the central axis of the diaphragm. Therefore, the sound pressure characteristics are obtained which is similar to the case in which the sound ejecting part 106 and sound ejecting hole 108 are formed about the central axis O of the diaphragm 38, and the air damping effect can be compensated. In the characteristics (FIG. 35) of the electroacoustic transducer shown in FIG. 30, it is illustrated especially clearly that there occurs abnormal vibrations due to chatterings when only the sound ejecting hole 108 is shifted from the central axis O of the diaphragm 100. In contrast to this, the electroacoustic transducer in the aforementioned embodiments does not produce such inadequacy.

As described above, the effect hereunder can be obtained according to the present invention:

a. the lowering of the air damping effect can be compensated when the sound ejecting hole is displaced from the central axis of the diaphragm, and the degree of freedom for the location of the sound ejecting part and sound ejecting hole can be enhanced;

b. since the air damping effect can be enhanced in proportion to the amplitude of the diaphragm, excessive vibrations or resonating vibrations can be suppressed, and abnormal sounds such as beats and modulated sounds when the sound pressure sharply changes can be damped;

c. since the air damping effect can be acted on the vibration amplitude higher than a specific level, the flatness of the frequency response characteristics of the sound pressure can be achieved; and d. the lowering of the air damping effect when the sound ejecting hole is displaced from the central axis of the diaphragm can be compensated without lowering the effect of the resonant chamber, with only adding the rib incorporated with the outer case.

While the specific embodiments of the present invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. An electroacoustic transducer comprising:

a resonant chamber;

a diaphragm located in the chamber for vibrating, the chamber adapted to resonate with vibrations of the diaphragm;

a sound ejecting hole for communicating the resonant chamber with outside air, the hole being offset in relation to a central axis of the diaphragm;

non-linear air damping wall means for compensating a lowered air damping effect in the chamber, relative to a chamber having a hole located coaxial with the central axis, the air damping means being provided on an inner wall of the resonant chamber and surrounding the central axis of the diaphragm.

2. An electroacoustic transducer as claimed in claim 1, wherein the air damping means is a hollow body surrounding the central axis of the diaphragm.

3. An electroacoustic transducer as claimed in claim 1, wherein the air damping means surrounds an air space around the central axis of the diaphragm and the sound ejecting hole is located inside the air space.

4. An electroacoustic transducer comprising:

an outer casing;

a diaphragm located within the casing and adapted to vibrate;

a resonant chamber formed inside the casing for establishing resonance in response to diaphragm vibrations;

a sound emitting passageway formed in the casing, offset from a central axis of the diaphragm, and connecting the resonant chamber to the atmosphere; and a hollow, continuous cavity air damping means surrounding a central diaphragm axis and extending from an inner surface of the chamber, for containing pressurized air therein, relative to the space outside the damping means, of increasing and decreasing pressure in response to diaphragm vibration, resulting in increased damping during rising diaphragm vibration amplitude thereby limiting such amplitude without contact of the diaphragm.

5. The transducer set forth in claim 4 wherein the hollow cavity means extends from a transverse wall surface opposite the diaphragm.

6. An electroacoustic transducer comprising:

an outer casing;

a diaphragm located within the casing and adapted to vibrate;

a resonant chamber formed inside the casing for establishing resonance in diaphram vibrations;

a sound emitting passageway formed in the casing, offset from a central axis of the diaphragm, and connecting the resonant chamber to the atmosphere; and a hollow, continuous cavity air damping means surrounding a central diaphragm axis and extending from an inner surface of the chamber, for containing pressurized air therein, relative to the space outside the damping means, of increasing and decreasing pressure in response to diaphragm vibration, resulting in increased damping during rising diaphragm vibration amplitude thereby limiting such amplitude without contact of the diaphragm, wherein the hollow cavity means has a circular cross-section and extends from a transverse wall surface opposite the diaphragm.

7. An electroacoustic transducer comprising;

an outer casing;

a diaphragm located within the casing and adapted to vibrate;

a resonant chamber formed inside the casing for establishing resonance in response to diaphragm vibrations;

a sound emitting passageway formed in the casing, offset from a central axis of the diaphragm, and connecting the resonant chamber to the atmosphere; and a hollow continuous cavity air damping means surrounding central diaphragm axis and extending from an inner surface of the chamber, for containing pressurized air therein, relative to the space outside the damping means, of increasing and decreasing pressure in response to diaphragm vibration, resulting in increased damping during rising diaphragm vibration amplitude thereby limiting such amplitude without contact of the diaphragm, wherein the hollow cavity means has an oblong cross-section and extends from a transverse wall surface opposite the diaphragm.

8. The transducer set forth in claim 7, wherein the sound emitting passageway communicates with an interior space of the hollow cavity means.

9. An electroacoustic transducer comprising:

an outer casing;

a diaphragm located within the casing and adapted to vibrate;

a resonant chamber formed inside the casing for establishing resonance in response to diaphragm vibrations;

a sound emitting passageway formed in the casing, offset from a central axis of the diaphragm, and connecting the resonant chamber to the atmosphere; and a hollow, continuous cavity air damping means surrounding a central diaphragm axis and extending from an inner surface of the chamber, for containing pressurized air therein, relative to the space outside the damping means, of increasing and decreasing pressure in response to diaphragm vibration, resulting in increased damping during rising diaphragm vibration amplitude thereby limiting such amplitude without contact of the diaphragm, wherein the hollow cavity means is a cylindrical body that extends from a transverse wall surface opposite the diaphragm.

* * * * *